US011280192B2

(12) United States Patent
Steele et al.

(10) Patent No.: US 11,280,192 B2
(45) Date of Patent: Mar. 22, 2022

(54) APPARATUS AND METHOD FOR PREPARING A BLAST HOLE IN A ROCK FACE DURING A MINING OPERATION

(71) Applicant: 1854081 ONTARIO LTD., Sudbury (CA)

(72) Inventors: Roderick Mark Steele, Chelmsford (CA); Colin Roos, Sudbury (CA)

(73) Assignee: 1854081 Ontario Ltd., Sudbury (CA)

( * ) Notice: Subject to any disclaimer, the term of this patent is extended or adjusted under 35 U.S.C. 154(b) by 186 days.

(21) Appl. No.: 16/465,254

(22) PCT Filed: Dec. 1, 2017

(86) PCT No.: PCT/CA2017/051445
§ 371 (c)(1),
(2) Date: May 30, 2019

(87) PCT Pub. No.: WO2018/098584
PCT Pub. Date: Jun. 7, 2018

(65) Prior Publication Data

US 2019/0323811 A1 Oct. 24, 2019

Related U.S. Application Data

(60) Provisional application No. 62/429,106, filed on Dec. 2, 2016.

(51) Int. Cl.
*E21B 19/08* (2006.01)
*E21C 37/00* (2006.01)
(Continued)

(52) U.S. Cl.
CPC ..... *E21C 37/00* (2013.01); *E21B 19/08* (2013.01); *F42D 1/08* (2013.01); *E21B 7/025* (2013.01); *E21D 9/006* (2013.01); *F42D 3/04* (2013.01)

(58) Field of Classification Search
CPC ..... F42D 1/00; F42D 1/08; F42D 3/04; E21C 37/00; E21B 19/08
See application file for complete search history.

(56) References Cited

U.S. PATENT DOCUMENTS 4,522,129 A * 6/1985 Jerberyd ..... F42D 1/10 104/138.1
4,592,282 A 6/1986 Niemi et al.
(Continued)

FOREIGN PATENT DOCUMENTS

AU 1338758 * 8/2003 ..... E21C 37/16
IT 2013098460 * 7/2013 ..... F21D 20/00
(Continued)

OTHER PUBLICATIONS

Tesman Incorporated, Remote Loading Project (6 Foot Phase—Pre and Post Cleaning Jumbo Drill Holes), Apr. 2015, published on https://www.tesman.ca, Canada.
(Continued)

*Primary Examiner* — Giovanna Wright
*Assistant Examiner* — Ronald R Runyan
(74) *Attorney, Agent, or Firm* — Blake, Cassels & Graydon LLP; Christopher N. Hunter; Laurie Wright

(57) ABSTRACT

Apparatus and methods for preparing a blast hole in a rock face during a mining operation are disclosed. An exemplary method comprises: deploying a first tool toward the blast hole in the rock face via a common tool outlet of a feed unit using a first tool station of the feed unit; retracting the first tool from the common tool outlet using the first tool station of the feed unit and retaining the first tool in the first tool station; and while the first tool is retained in the first tool station, deploying a second tool toward the blast hole in the rock face through the common tool outlet of the feed unit using a second tool station of the feed unit.

14 Claims, 25 Drawing Sheets

(51) Int. Cl.

| | |
|---|---|
| ***F42D 1/08*** | (2006.01) |
| *F42D 3/04* | (2006.01) |
| *E21D 9/00* | (2006.01) |
| *E21B 7/02* | (2006.01) |

(56) References Cited

U.S. PATENT DOCUMENTS 8,342,261 B2 * 1/2013 Ahola ..... F42D 3/04 175/2
8,418,618 B2 * 4/2013 Ahola ..... E21C 37/16 102/313

FOREIGN PATENT DOCUMENTS

| | | | |
|---|---|---|---|
| WO | 2009114704 | A2 | 9/2009 |
| WO | 2013170348 | A1 | 11/2013 |
| WO | 2015107069 | A1 | 7/2015 |

OTHER PUBLICATIONS

Tesman Incorporated, Remote Loading Project (6 Foot Phase—Pre and Post Cleaning Jumbo Drill Holes), Aug. 2015, published on https://www.tesman.ca, Canada.
Tesman Incorporated, Remote Loading Project (6 Foot Phase—Pre and Post Cleaning Jumbo Drill Holes), Oct. 2014, published on https://www.tesman.ca, Canada.
Tesman Incorporated, Remote Loading Project (6 Foot Phase—Pre and Post Cleaning Jumbo Drill Holes), Nov. 2014, published on https://www.tesman.ca, Canada.
Tesman Incorporated, Remote Loading Project (6 Foot Phase—Pre and Post Cleaning Jumbo Drill Holes), Dec. 2014, published on https://www.tesman.ca, Canada.
Tesman Incorporated, Remote Loading Project (6 Foot Phase—Pre and Post Cleaning Jumbo Drill Holes), Jan. 2015, published on https://www.tesman.ca, Canada.
Tesman Incorporated, Remote Loading Project (6 Foot Phase—Pre and Post Cleaning Jumbo Drill Holes), Feb. 2015, published on https://www.tesman.ca, Canada.
Tesman Incorporated, Remote Loading Project (6 Foot Phase—Pre and Post Cleaning Jumbo Drill Holes), Mar. 2015, published on https://www.tesman.ca, Canada.
Tesman Incorporated, Remote Loading Project (6 Foot Phase—Pre and Post Cleaning Jumbo Drill Holes), May 2015, published on https://www.tesman.ca, Canada.
Tesman Incorporated, Remote Loading Project (6 Foot Phase—Pre and Post Cleaning Jumbo Drill Holes), Sep. 2015 to Mar. 2016, published on https://www.tesman.ca, Canada.
PCT International Search Report and Written Opinion dated Mar. 5, 2018 re: International Application No. PCT/CA2017/051445.

* cited by examiner

APPARATUS AND METHOD FOR PREPARING A BLAST HOLE IN A ROCK FACE DURING A MINING OPERATION

CROSS REFERENCE TO RELATED APPLICATION AND CLAIM OF PRIORITY

This application is a national phase application under 35 U.S.C. 371 of International Patent Application No. PCT/CA2017/051445 filed on Dec. 1, 2017, which claims priority to U.S. provisional patent application no. 62/429,106 filed on Dec. 2, 2016, the entire contents of which are hereby incorporated by reference.

TECHNICAL FIELD

The disclosure relates generally to mining operations that use drilling and blasting techniques, and more particularly to the preparation of blast holes for such mining operations.

BACKGROUND OF THE ART

Some mining operations use a drilling and blasting technique which uses an explosive substance that can break rock for excavation. During such operations, a number of blast holes are drilled into a rock face of an excavation, which may be in an underground tunnel for example, and the blast holes are filled with the explosive substance. The explosive substance is then detonated which causes the adjacent rock to break. The broken rock (i.e., rubble) is then removed from the tunnel and the newly formed portion of the tunnel is reinforced. The process is repeated until the desired excavation (e.g., tunnel depth or length) is achieved.

Prior to filling the blast holes with the explosive substance, the blast holes are typically inspected and cleared of debris to make sure that the explosive substance and the associated detonator can be safely inserted into the blast holes and to the proper depth. Such inspection, clearing and subsequent filling of the blast holes can require mining personnel to be in close proximity to the rock face, which can generally be considered unsafe. Improvement is desirable.

SUMMARY

In one aspect, the disclosure describes an apparatus for preparing a blast hole in a rock face during a mining operation. The apparatus comprises:

a support structure; and a feed unit supported by the support structure, the feed unit comprising a plurality of tool stations in communication with a common tool outlet, each tool station comprising a drive mechanism configured to deploy a tool out of the common tool outlet to deliver the tool to the blast hole in the rock face and to retract the tool from the common tool outlet, each tool station being configured to retain its respective tool in the tool station when the respective tool is retracted from the common tool outlet.

The feed unit may comprise respective tool-receiving apertures for loading the respective tools into each of the tool stations. The tool receiving apertures may be disposed on a side of the tool stations opposite of the common tool outlet.

The feed unit may comprise a tool guiding portion configured to guide each tool from its respective tool station toward the common tool outlet.

The tool guiding portion may comprise guide tubes respectively associated with the tool stations.

The apparatus may comprise a tool delivery tube for receiving one of the tools from the common tool outlet and for guiding the one of the tools to the blast hole.

The apparatus may comprise a camera operatively coupled to a display device. The camera may be configured to capture an image of the blast hole.

The support structure may comprise an articulated arm including a proximal arm portion and a distal arm portion articulately connected to the proximal arm portion. The feed unit may be mounted to the proximal arm portion.

The support structure may comprise a personnel basket and the proximal arm portion of the articulated arm may be articulately connected to the personnel basket.

In some embodiments, at least one of the tool stations is configured to prevent a driving force exerted on its respective tool from exceeding a predetermined value.

The apparatus may comprise a plurality of redundant systems for preventing the driving force exerted on the respective tool from exceeding the predetermined value.

The drive mechanism of the at least one tool station may be configured to exert a calibrated gripping force on the respective tool. The gripping force may be calibrated to cause slipping of the drive mechanism relative to the respective tool to prevent the driving force exerted on the respective tool from exceeding the predetermined value.

The drive mechanism of the at least one tool station may comprise an electric motor. The feed unit may be configured to prevent the electric motor from drawing an amount of current over a current limit correlated to the predetermined value of the driving force exerted on the respective tool.

The apparatus may comprise at least one sensor configured to measure an output torque of the electric motor. The at least one sensor may comprise a pair of strain gauges coupled to one or more mounts of the electric motor.

The drive mechanism of the at least one tool station may comprise a drive wheel drivingly coupled to the electric motor, and an idler wheel. The drive wheel and the idler wheel may be configured to engage with the respective tool when the respective tool is driven. The apparatus may comprise:

a first encoder operatively coupled to the electric motor;

a second encoder operatively coupled to the idler wheel; and a controller operatively coupled to the first encoder and to the second encoder, the controller being configured to, using signals from the first encoder and from the second encoder, detect slipping of the drive wheel relative to the respective tool.

The drive mechanism of the at least one tool station may comprise a drive wheel and an idler wheel. The drive wheel and the idler wheel may be configured to engage with the respective tool when the respective tool is driven.

The idler wheel may be resiliently biased to urge the respective tool against the drive wheel.

The apparatus may comprise a load cell configured to measure a reaction force on the drive wheel. The reaction force may be indicative of the driving force exerted on the respective tool by the drive wheel.

The apparatus may comprise a sensor configured to detect a presence of one of the tools at the common tool outlet.

The apparatus may comprise at least one sensor configured to measure a deployed distance of at least one of the tools.

The drive mechanism of at least one of the tool stations may comprise a drive wheel and an idler wheel. The drive wheel and the idler wheel may be configured to engage with the respective tool. The idler wheel may be configured to urge the respective tool against the drive wheel and provide a calibrated gripping force on the respective tool. The gripping force may be calibrated to cause slipping of the drive wheel relative to the respective tool to prevent the driving force exerted on the respective tool from exceeding a predetermined value. The apparatus may further comprise:

a motor drivingly coupled to the drive wheel of the drive mechanism;

a first sensor configured to measure a first parameter representative the driving force exerted on the respective tool;

a second sensor configured to measure a second parameter representative the driving force exerted on the respective tool; and a controller operatively coupled to the motor, to the first sensor and to the second sensor, the controller being configured to substantially prevent the motor from exerting a driving force on the respective tool that exceeds the predetermined value.

The first parameter may be an output torque of the motor.

The first parameter may be a reaction force on the drive wheel.

The motor may be an electric motor and the second parameter may be a current draw of the electric motor.

The motor may be a hydraulic motor or a pneumatic motor.

The support structure may be a mobile platform.

The apparatus may comprise at least one of the tools. The tool may be tethered for deployment using the feed unit.

The tool may comprise an impact tool.

The tool may comprise a flushing tool.

The flushing tool may have an outer wall extending about a central axis. The outer wall may comprise a plurality of holes for discharging fluid. The holes may be oriented to have a radial and an axial component relative to the central axis.

The tool may comprise an endoscope. The endoscope may comprise two or more spaced apart viewing channels.

The endoscope may be coupled to another tool via a coupler. The coupler may comprise a first interface for coupling to the endoscope and a second interface for coupling to the other tool. The coupler may define one or more windows in optical communication with the viewing channels of the endoscope.

The one or more windows may comprise open radial slots defined by circumferentially spaced apart ribs extending between the first and second interfaces of the coupler.

The tool may comprise a tamping tool. The tamping tool may comprise a receiving area in which a payload of substance is received and a piston configured to push the payload out of receiving area for delivering the payload of substance.

The tool may comprise a shearing tool. The shearing tool may comprise opposed pivotable shearing blades. The shearing blades may each have a cutting edge having a concave longitudinal profile.

The tool may comprise a spraying tool.

The tool may comprise an explosive delivery hose.

The tool may comprise an auger.

The tool may comprise a rotary driver. The rotary driver may be coupled to cause rotation of another tool. The rotary driver may comprise a fluid passage extending axially therethrough to permit delivery of a fluid (e.g., air or water) to a distal end of the rotary driver.

The fluid passage may comprise an annular opening disposed at the distal end of the rotary driver.

The tool may comprise a stabilizing tool. The stabilizing tool may comprise one or more radially deployable members for engaging with an inner surface of the blast hole.

The tool may be attached to an electrically conductive hose.

The tool may comprise a geological sampling tool.

The tool may comprise an X-ray fluorescence analyzer.

The apparatus may be programmable to automatically execute a predefined tool path for the tool.

The apparatus may comprising a remote operator control station comprising an input device for receiving an input from an operator of the apparatus. The remote operator control station may be disposed remotely from the support structure.

Embodiments may include combinations of the above features.

In another aspect, the disclosure describes a feed unit for preparing a blast hole in a rock face during a mining operation. The feed unit may comprise:

a first tool station in communication with a common tool outlet, the first tool station comprising a first drive mechanism configured to deploy a first tool out of the common tool outlet to deliver the first tool to the blast hole in the rock face and to retract the first tool from the common tool outlet, the first tool station being configured to retain the first tool in the first tool station when the first tool is retracted from the common tool outlet; and a second tool station in communication with the common tool outlet, the second tool station comprising a second drive mechanism configured to deploy a second tool out of the common tool outlet to deliver the second tool to the blast hole in the rock face and to retract the second tool from the common tool outlet, the second tool station being configured to retain the second tool in the second tool station when the second tool is retracted from the common tool outlet.

The feed unit may comprise a first guide tube for guiding the first tool toward the common tool outlet and a second guide tube for guiding the second tool toward the common tool outlet.

The first tool station may be configured to prevent a driving force exerted on the first tool from exceeding a predetermined value.

The feed unit may comprise a plurality of redundant systems for preventing the driving force exerted on the first tool from exceeding the predetermined value.

The first drive mechanism of the first tool station may be configured to exert a calibrated gripping force on the first tool. The gripping force may be calibrated to cause slipping of the first drive mechanism relative to the first tool to prevent the driving force exerted on the first tool from exceeding the predetermined value.

The first drive mechanism may comprise a controller and an electric motor operatively coupled to the controller.

The controller may be configured to prevent the electric motor from drawing an amount of current over a current limit correlated to the predetermined value of the driving force exerted on the first tool.

The feed unit may comprise at least one sensor configured to measure an output torque of the electric motor. The at least one sensor may comprise a pair of strain gauges coupled to one or more mounts of the electric motor.

The first drive mechanism may comprise a drive wheel drivingly coupled to the electric motor, and an idler wheel.

The drive wheel and the idler wheel may be configured to engage with the first tool when the first tool is driven. The feed unit may comprise:

a first encoder operatively coupled to the electric motor; and a second encoder operatively coupled to the idler wheel;

wherein the controller is operatively coupled to the first encoder and to the second encoder, the controller being configured to, using signals from the first encoder and from the second encoder, detect slipping of the drive wheel relative to the first tool.

The first drive mechanism may comprise a drive wheel and an idler wheel. The drive wheel and the idler wheel may be configured to engage with the first tool when the first tool is driven.

The idler wheel may be resiliently biased to urge the first tool against the drive wheel.

The feed unit may comprise a load cell configured to measure a reaction force on the drive wheel. The reaction force may be indicative of the driving force exerted on the first tool by the drive wheel.

The feed unit may comprise a sensor configured to detect a presence of the first tool at the common tool outlet.

The feed unit may comprise a sensor configured to measure a deployed distance of the first tool.

The first drive mechanism may comprise a drive wheel and an idler wheel. The drive wheel and the idler wheel may be configured to engage with the first tool. The idler wheel may be configured to urge the first tool against the drive wheel and provide a calibrated gripping force on the first tool. The gripping force may be calibrated to cause slipping of the drive wheel relative to the first tool to prevent a driving force exerted on the first tool from exceeding a predetermined value. The feed unit may further comprise:

a motor drivingly coupled to the drive wheel of the first drive mechanism;

a first sensor configured to measure a first parameter representative the driving force exerted on the first tool;

a second sensor configured to measure a second parameter representative the driving force exerted on the first tool; and a controller operatively coupled to the motor, to the first sensor and to the second sensor, the controller being configured to substantially prevent the motor from exerting a driving force on the respective tool that exceeds the predetermined value.

The first parameter may be an output torque of the motor.

The first parameter may be a reaction force on the drive wheel.

The motor may be an electric motor and the second parameter may be a current draw of the electric motor.

Embodiments may include combinations of the above features.

In another aspect, the disclosure describes a method for preparing a blast hole in a rock face during a mining operation using a feed unit. The method may comprise:

deploying a first tool toward the blast hole in the rock face via a common tool outlet of the feed unit using a first tool station of the feed unit;

after a first operation has been performed at the blast hole using the first tool, retracting the first tool from the common tool outlet using the first tool station of the feed unit and retaining the first tool in the first tool station; and while the first tool is retained in the first tool station, deploying a second tool toward the blast hole in the rock face through the common tool outlet of the feed unit using a second tool station of the feed unit.

The method may comprise loading the first and second tools into the respective first and second tool stations via respective first and second tool-receiving apertures disposed on a side of the tool stations opposite of the common tool outlet.

The method may comprise:

guiding the first tool toward the common tool outlet when deploying the first tool; and guiding the second tool toward the common tool outlet when deploying the second tool.

The method may comprise inserting a detonator inside the blast hole using the second tool.

The method may comprise at least partially filling the blast hole with an explosive substance using the second tool.

The method may comprise preventing a driving force exerted on the first tool from exceeding a first predetermined value when deploying the first tool.

The method may comprise exerting a first calibrated gripping force on the first tool when deploying the first tool. The first gripping force may be calibrated to cause slipping to prevent the driving force exerted on the first tool from exceeding the first predetermined value.

The method may comprise preventing a driving force exerted on the second tool from exceeding a second predetermined value when deploying the second tool.

The method may comprise exerting a second calibrated gripping force on the second tool when deploying the second tool. The second gripping force may be calibrated to cause slipping to prevent the driving force exerted on the second tool from exceeding the second predetermined value.

The method may comprise actively limiting an output torque of a motor used to deploy any one of the first tool and the second tool.

The method may comprise monitoring the output torque of the motor by monitoring an electrical current draw of the motor.

The method may comprise measuring a deployed distance of any one of the first tool and the second tool.

The method may comprise detecting a presence of any one of the first tool and the second tool at the common tool outlet.

The method may comprise using a plurality of redundant systems to prevent a driving force exerted on any one of the first tool and the second tool from exceeding a predetermined value.

The first or second tool may comprise an impact tool.

The method may comprise performing a flushing operation of the blast hole.

The first or second tool may comprise an endoscope.

The method may comprise mapping an inside of the blast hole using the endoscope.

The method may comprise delivering an explosive substance to the blast hole.

The method may comprise performing a shearing operation.

The method may comprise performing a spraying operation.

The method may comprise stabilizing the first or second tool against an inside surface of the blast hole.

The method may comprise collecting a geological sample.

The method may comprise analyzing a composition of the geological sample using the first or second tool.

The method may comprise automatically moving the first or second tool along a preprogrammed tool path.

The method may comprise digitizing a rock surface using the first or second tool and generating a preprogrammed tool path using the digitized rock surface.

The method may comprise rotating the first or second tool using a rotary driver.

The method may comprise delivering a fluid to the first or second tool during the first or a second operation.

Embodiments may include combinations of the above features.

Further details of these and other aspects of the subject matter of this application will be apparent from the detailed description included below and the drawings.

DESCRIPTION OF THE DRAWINGS

Reference is now made to the accompanying drawings, in which.

DETAILED DESCRIPTION

The following disclosure relates to apparatus and methods for preparing (e.g., inspecting, clearing and loading) blast holes in a rock face during a mining operation. In some embodiments the apparatus and methods disclosed herein may improve the safety of mining personnel by eliminating or reducing the need for mining personnel to be in close proximity to the rock face during such preparation of the blast holes. In some embodiments, the use of the apparatus and methods disclosed herein may provide a relatively efficient way of preparing such blast holes while keeping mining personnel at a safe distance from the rock face.

Aspects of various embodiments are described through reference to the drawings.

Figure 1:
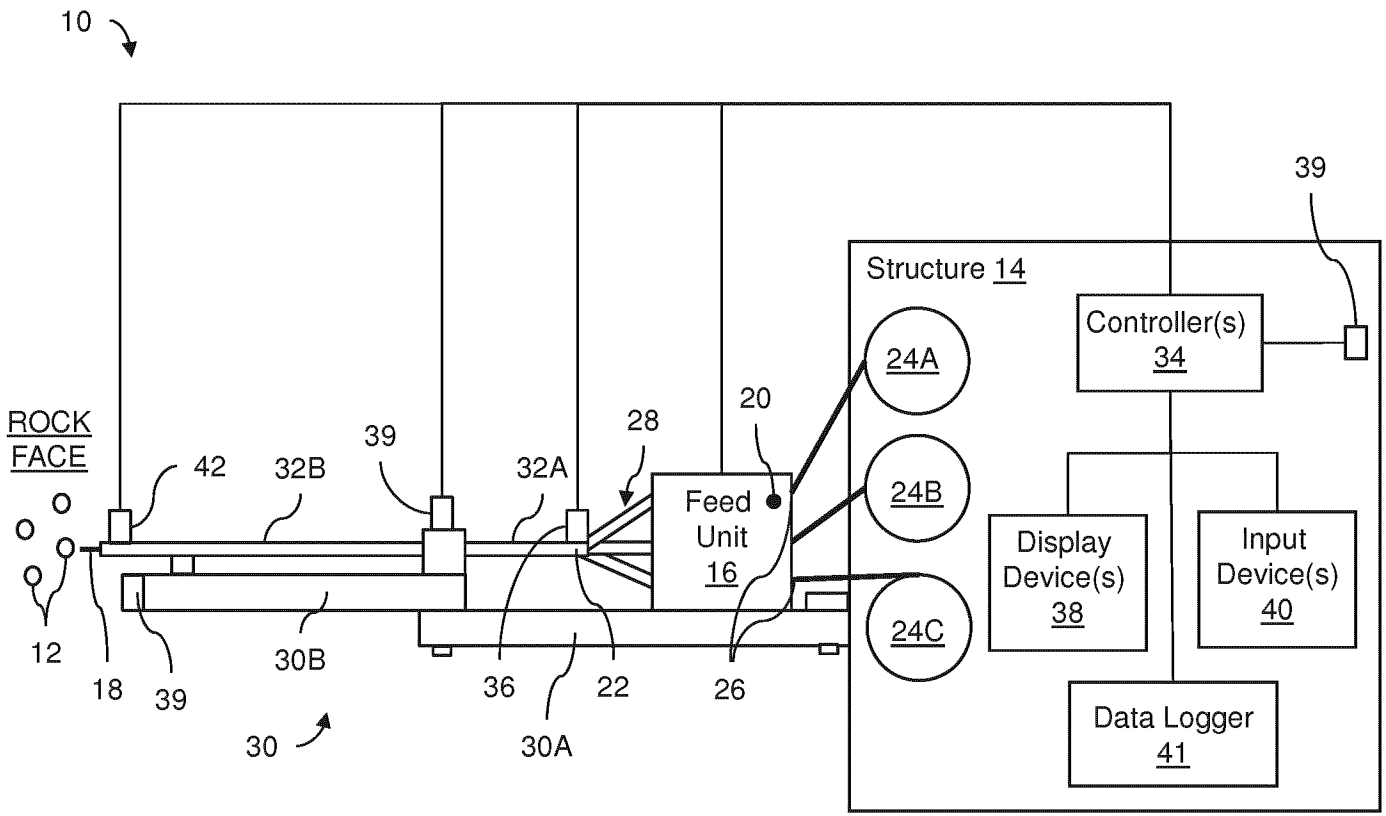
FIG. 1 shows a schematic representation of an exemplary apparatus for preparing a blast hole in a rock face during a mining operation.

FIG. 1 shows a schematic representation of an exemplary apparatus 10 for preparing a blast hole 12 in a rock face during a mining operation. For the purpose of the present disclosure "preparing" of blast hole 12 is intended to encompass one or more tasks such as inspecting, clearing and loading of blast hole 12. The loading of blast hole 12 may include inserting a suitable detonator (e.g. blasting cap) inside blast hole 12 and at least partially filling blast hole 12 with a suitable explosive substance.

The use of apparatus 10 is not intended to be limited to any specific type of preparation tool or to any specific type of explosive substance. For example, apparatus 10 may be used with different varieties of explosives including ammonium nitrate/fuel oil (ANFO)-based blends or a suitable emulsion explosive agent. Apparatus 10 may be used with explosives of different forms including powders, emulsions and stick form.

In various embodiments, apparatus 10 may comprise support structure 14 and feed unit 16 which may be directly or indirectly supported by structure 14. In various embodiments, structure 14 may comprise a mobile platform such as a vehicle suitable for travelling in a mining excavation such as an underground tunnel. In some embodiments, structure 14 may be adapted to carry mining personnel. For example, structure 14 may comprise a personnel basket also known as a "man basket" carrying mining personnel involved with controlling or supervising at least some aspect of operation of apparatus 10. Structure 14 may, for example, comprise a scissor lift, a front end loader with an excavation bucket or a mobile platform equipped with a boom. In various embodiments, structure 14 may comprise any suitable mobile platform capable of supporting any part(s) of apparatus 10 during operation.

Apparatus 10 may be configured to assist mining personnel with carrying out one or more tasks associated with preparing blast holes 12 while allowing the mining personnel to stay at a safe distance from the rock face while carrying out such task(s). Apparatus 10 may be configured to deploy and retract one or more tools 18 to and from the rock face to perform respective tasks. In various embodiments, feed unit 16 may comprise a plurality of tool stations 20 (shown in more detail in FIG. 4) in communication with a single common tool outlet 22. Each tool station 20 may comprise a drive mechanism configured to deploy a respective tool 18 out of common tool outlet 22 to deliver the respective tool to blast hole 12 in the rock face and also configured to retract the respective tool 18 from common tool outlet 22. Each tool station 20 may be configured to retain its respective tool 18 in the tool station 20 when the respective tool 18 is retracted from common tool outlet 22. Accordingly, the tools 18 retained in different tool stations 20 may remain ready and available for deployment when needed. In other words, tools 18 commonly needed for preparing blast holes 12 may remain loaded into feed unit 16 and this may thereby reduce or eliminate the need for mining personnel to repeatedly unload and load tools 18 into feed unit 16 to switch tools 18. Feed unit may comprise a suitable number of tool stations 20 to accommodate an appropriate number of tools 18 most commonly used during such operations. In some embodiments, feed unit 16 may comprise two tool stations 20. In some embodiments, feed unit 16 may comprise three or more tool stations 20.

Feed unit 16 may be configured to deploy and retract different types of tools 18 such as, for example, an endoscope for inspecting blast hole 12, an impact tool (e.g., chisel) driven by compressed air for breaking-up debris in blast hole 12, a water hose and/or an air hose for clearing smaller debris from blast hole 12, an auger tool driven by a rotary driver for clearing debris from blast holes 12 (e.g., of a lower row of blast holes 12), a spraying tool, a shearing tool for cutting and removing pieces of screen typically installed against the rock surface, a flushing tool for flushing loose debris out of a blast hole, a tamping tool for delivering an explosive or other substance into a drilled hole, a geological sampling tool, an X-ray fluorescence (XRF) analyzer for determining the elemental composition of materials and, an explosive delivery hose for inserting a detonator into blast hole 12 and subsequently at least partially filling blast hole 12 with an explosive substance.

Feed unit 16 may be used in conjunction with suitable explosive loading equipment for the purpose of deploying the explosive delivery hose of such explosive loading equipment into blast hole 12 for inserting a detonator to the bottom of blast hole 12 and subsequently loading blast hole 12 with the explosive substance. In some embodiments, the gripping force applied to the explosive delivery hose in tool station 20 may be released in order to permit the explosive loading equipment to retract the explosive delivery hose at the desired speed as the explosive substance is inserted into blast hole 12 via the explosive delivery hose. Alternatively, the gripping force may be maintained on the explosive delivery hose so that it may be retracted at a desired speed while the explosive substance is loaded into blast hole 12 to provide a substantially uniform column of explosive substance (e.g., anfo or emulsion) in blast hole 12. The retraction of the explosive delivery hose may be substantially automatic via controller 34 or controlled manually via input device 40 (e.g., joystick) by mining personnel. As explained below, (e.g., haptic, tactile) sensing and control of the deployment and/or retraction of tool 18 via tool station 20 may facilitate the loading of blast hole 12 with the explosive substance.

Tools 18 suitable for use with feed unit 16 may be elongated or may be tethered by via a cable or hose for example to permit deployment/retraction of such tools 18 to/from the rock face via feed unit 16, which may be located at a distance of several meters from the rock face. For example, such tools 18 may be or comprise (e.g., pneumatic, hydraulic) hoses or may be tethered by such hose and/or by an electric cable. In some embodiments, tools 18 may be tethered via a hose or cable that is electrically conductive (e.g., semi-conductive). Semi-conductive hoses can be used to deliver explosive substances and may help dissipate static electricity. Such tools 18 may be wound on suitable reels 24A-24C mounted to structure 14. In the case where one of tools 18 is an explosive loading hose, such explosive loading hose may be in communication with explosive loading equipment that may be separate from structure 14. The hoses/cables associated with tools 18 may be sufficiently flexible so as to extend from feed unit 16 to the rock face along a curved path and optionally be wound on reels 24A-24C when retracted. However, the hoses/cables may have sufficient rigidity to be gripped and propelled toward the rock face by feed unit 16 for example. It is understood that different types of tools 18 may be required for different operations and for loading explosive substances of different types/forms.

Feed unit 16 may comprise respective tool-receiving apertures 26 for loading respective tools 18 into each of the tool stations 20. In some embodiments, tool receiving apertures 26 may be disposed on a side of feed unit 16 (and of tool stations 20) that is opposite of common tool outlet 22 so that tools 18 may extend through feed unit 16 when deployed to the rock face. The configuration of tools stations 20 may facilitate the loading and unloading of tools 18 in feed unit 16 in a substantially "plug-and-play" manner.

Even though feed unit 16 may comprise a plurality of tool stations 20, only one tool 18 may be deployed at a time via the single common tool outlet 22 for the appropriate cycle time to conduct the desired operation and then retracted before a subsequent tool 18 may be deployed if necessary to conduct a subsequent operation. Accordingly, feed unit 16 may comprise a tool guiding portion configured to guide each tool 18 from its respective tool station 20 toward common tool outlet 22. In some embodiments, feed unit 16 may comprise a single, funnel-shaped (e.g., cone-shaped) tool guide 28 which may be shaped and configured to direct any one of tools 18 toward common tool outlet 22 during deployment. Alternatively, in some embodiments, feed unit 16 may comprise a separate tool guide associated with each tool station 20 for separately guiding each tool 18 toward common tool outlet 22. For example, feed unit 16 may comprise separate respective guide tubes 28A-28C as illustrated in FIG. 2 for receiving respective tools 18 therein and guiding the respective tools 18 being deployed from respective tool stations 20 to common tool outlet 22.

In some embodiments, structure 14 may comprise a powered/robotic articulated arm 30 including one or more arm portions such as, for example, proximal arm portion 30A and distal arm portion 30B articulately connected to proximal arm portion 30A. The terms "proximal" and "distal" are used herein to describe opposite directions along articulated arm 30. The term "proximal" is used to describe a direction toward the operator of apparatus 10 (i.e., away from the rock face in FIG. 1) and the term "distal" is used to describe a direction away from the operator of apparatus 10 (i.e., toward the rock face in FIG. 1). Articulate arm 30 may be actuated via suitable electric motors (not shown) and may be controlled via controller 34. In some embodiments, articulated arm 30 may be actuated via pneumatic or hydraulic motors.

In some embodiments, feed unit 16 may be mounted to proximal arm portion 30A. Proximal arm portion 30A of the articulated arm 30 may be articulately connected directly or indirectly to a personnel basket so that feed unit 16 may be accessible to mining personnel from within the personnel basket. For example, feed unit 16 may be disposed within arm's length of the personnel basket. Apparatus 10 may comprise tool delivery tube 32 for receiving tool 18 being deployed from common tool outlet 22 of feed unit 16 and guiding tool 18 to blast hole 12 generally along articulated arm 30. Tool delivery tube 32 may be mounted to articulated arm 30 in any suitable manner. In some embodiments tool delivery tube 32 may comprise proximal delivery tube portion 32A and distal delivery tube portion 32B. Distal delivery tube portion 32B may be articulate to proximal delivery tube portion 32A to accommodate the movement of articulated arm 30.

In some embodiments, articulated arm 30 may be configured to articulate to permit a distal end of a tool 18 deployed from feed unit 16 and extending out of delivery tube 32 to be brought in close proximity to the personnel basket for inspection by mining personnel or for other purpose. For example, when an explosive delivery hose is deployed using feed unit 16, the distal end of the explosive delivery hose that extends out of distal delivery tube portion 32B may be brought toward the personnel basket so that mining personnel may install a detonator to the distal end of the explosive delivery hose before inserting the hose into blast hole 12 and delivering the detonator to the bottom of blast hole 12. In some embodiments, the use of feed unit 16 and articulated arm 30 may permit mining personnel to inspect, clear and load blast holes 12 remotely while remaining at a safe distance of several meters from the rock face. In some embodiments, such preparation of blast hole 12 may be conducted while mining personnel is in the personnel basket at a distance of about 3.5 m (12 ft) from the rock face.

In some embodiments, apparatus 10 may comprise one or more controllers 34 (referred hereinafter in the singular) part of or operatively coupled to feed unit 16 and optionally to other components (e.g., sensors) of apparatus 10 for facilitating the control of at least some aspect of apparatus 10. In some embodiments, controller 34 may be configured to facilitate the control, automation and monitoring of some tasks performed by feed unit 16 and optionally by other parts of apparatus 10. For example, controller 34 may be configured to execute predefined sets of instructions automatically or semi-automatically for automated operation of apparatus 10 via programmed instructions. Controller 34 may be configured to automatically control apparatus 10 to execute a predefined series of tasks based on a predefined program. For example, such program could include a desired series of movements (e.g., tool path) for tool 18 disposed at the distal end of articulated arm 30.

Controller 34 may be configured to cause articulated arm 30 to automatically return a deployed tool 18 to a known position of blast hole 12 stored in some memory of controller 34. For example, controller 34 may be operatively coupled to sensor 36 for detecting the presence of one of tools 18 at common tool outlet 22 and prevent the deployment of a second tool 18 if a first tool 18 is already deployed. In some embodiments, sensor 36 may be a suitable proximity sensor. As explained further below together with other functions of controller 34, controller 34 may be configured to control tool feed unit 16 to prevent a driving force exerted on one or more tools 18 from exceeding a predetermined value when such one of tools 18 are deployed or retracted. In some embodiments, controller 34 or some functionality or part(s) thereof may be considered part of feed unit 16.

Controller 34 may comprise one or more digital computer(s) or other data processors networked together. Controller 34 may, for example, be configured to make decisions regarding the control of apparatus 10 and cause some actions to be carried out by apparatus 10 based on input from mining personnel located either on-site or remotely from controller 34. For example, controller 34 may be configured to be operated remotely. Controller 34 may comprise data storage means (e.g., device(s)) which may include a suitable combination of any type of computer memory suitable for retrievably storing machine-readable instructions executable by one or more processors of controller 34. Such data storage means (i.e., memory(ies)) may comprise tangible, non-transitory medium. Embodiments of apparatus 10 and methods described herein may be implemented in a combination of both hardware and software. For example, aspects of the embodiments disclosed herein may be implemented in the form of a computer program product embodied in one or more non-transitory computer readable medium(ia) having computer readable program code (machine-readable instructions) stored thereon. Such computer program product(s) may, for example, be executed by controller 34 to cause the execution of one or more tasks or methods disclosed herein in entirety or in part.

Apparatus 10 may also comprise one or more display devices 38 and one or more input devices 40 operatively coupled to controller 34. Display device 38 may provide visual feedback (e.g., readout of numerical values, video feed of the rock face) to mining personnel associated with the operation of apparatus 10. In some embodiments, display device 38 may be touch sensitive and may also serve the function of an input device. Input device 40 may include a keyboard, mouse, push buttons, switches, joystick, data input interface or any suitable device permitting controller 34 to receive data from mining personnel or other device(s).

In some embodiments, apparatus 10 may comprise camera 42 operatively coupled to display device 38 (e.g., via controller 34 or otherwise). Camera 42 may be positioned and oriented to capture an image of blast hole 12 and/or of tool 18 when tool 18 is carrying out a task at blast hole 12.

Apparatus 10 may comprise one or more sensors 39 disposed on different parts of apparatus 10 for monitoring the use of apparatus 10 and/or providing suitable feedback for controlling the operation of apparatus 10. Sensors 39 may provide position, velocity, acceleration and/or forces at various locations on apparatus 10. In some embodiments, sensors 39 may comprise resolvers, encoders and/or accelerometers at each articulation of articulated arm 30 so that suitable monitoring and control of the movements of articulated arm 30 may be performed by controller 34. In some embodiments, sensors 39 may comprise inertial measurement units.

In various embodiments, sensors 39 may provide helpful feedback for controlling apparatus 10 and/or provide helpful feedback for monitoring whether the use of apparatus 10 is within its operational limits. For example, the use of sensors 39 may provide feedback as to whether part of apparatus 10 was overloaded, has been subjected to a collision, has been subjected to an excessive acceleration during transit, and/or has otherwise potentially suffered damage. For example, suitable inertial measurement units may be used to record the history of the vibrations experienced at different locations on articulated arm 30. Such vibration data may be used to confirm that articulated arm 30 was properly stowed and seated during transit of apparatus 10.

The use of sensors 39 may be useful to maintenance personnel for monitoring the usage of apparatus 10 and schedule/plan appropriate maintenance or inspections based on the usage of apparatus 10. Sensors 39 may be used to record the history of the movements performed by articulated arm 30 and also map the movements and tasks performed by apparatus 10. For example, sensors 39 may be used to record coordinates (e.g., X, Y and Z) positions of tool 18 located at the distal end of articulated arm 30.

Feedback from sensors 39 may also be useful to mining personnel (e.g., geologists, engineers). For example, sensors 39 may serve to provide a log of the tasks performed by apparatus 10 (e.g., the use of tools 18) together with the relevant positional data. Such log can, for example, be used for monitoring the performance, safety and quality of mining operations. For example, such data can be used to verify the locations of blast holes 12, whether blast holes 12 were properly prepared (e.g., cleared and loaded with explosive), the number, positions (e.g., spacing) and depth of blast holes 12 filed with explosive. In some situations, such data can be used by mining personnel to determine suitable timing for the rounds of explosive during blasting to improve the synergy between rounds of explosives. Such data can also be used by mining personnel for troubleshooting, quality assurance and/or validating a geological model associated with the mining excavation.

Historical usage data on the use of apparatus 10 obtained via sensors 39 and/or otherwise may be stored in suitable memory located at controller(s) 34 and/or at data logger 41. Data logger 41 may comprise suitable machine-readable memory for storing the historical data. The historical data may be used for displaying relevant usage or other information (e.g., 2D or 3D maps) on display device 38 for consideration by an operator of apparatus 10. Alternatively or in addition, the usage information may be used by mining personnel located remotely from apparatus 10 either substantially in real time or for subsequent analysis after the operation of apparatus 10. Accordingly, the data stored in data logger 41 may be transmitted to a remote location by wired or wireless data transmission or data logger 41 may comprise a suitable removably coupled storage medium (e.g., flash memory card).

Figure 2A:
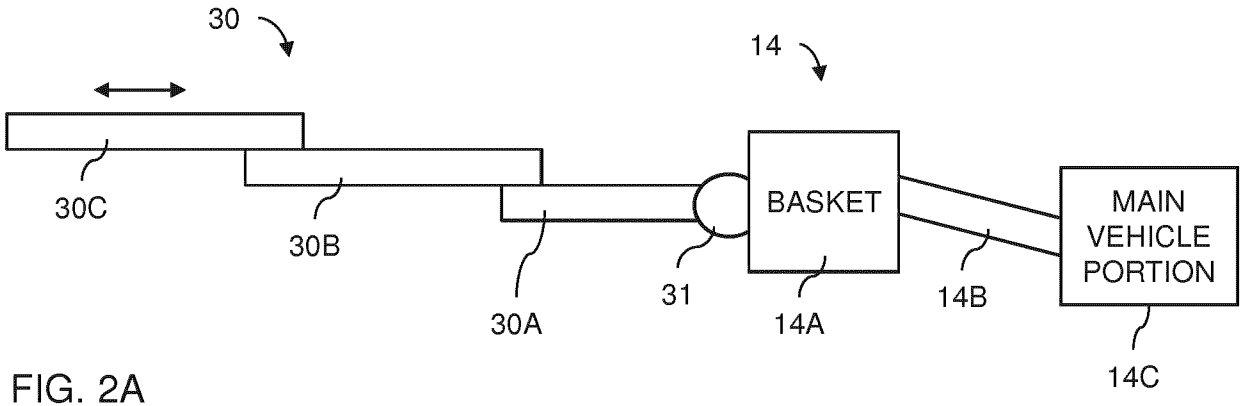
FIGS. 2A and 2B are schematic representations of exemplary articulated arms and associate support structures of the apparatus of FIG. 1.
Figure 2B:
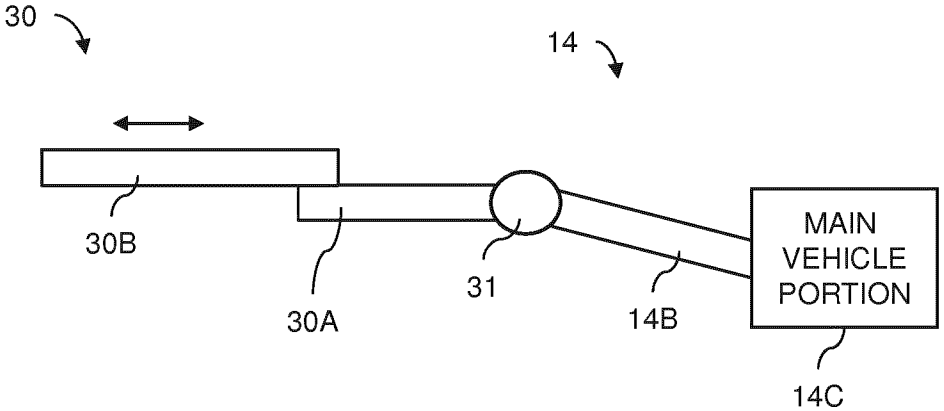

FIGS. 2A and 2B are schematic representations of other exemplary articulated arms 30 and associate support structures 14. It is understood that apparatus 10 may comprise articulated arm 30 and support structure 14 of various types and configurations not limited to those disclosed herein. Other components of apparatus 10 have been omitted from FIGS. 2A and 2B for the sake of clarity. As shown in FIG. 2A, articulated arm 30 may comprise a plurality of arm portions 30A-30C (e.g., two or more) coupled to personnel basket 14A. In various embodiments, arm portions 30A-30C may be longitudinally translatable and/or pivotable relative to each other and coupled to personnel basket 14A in any suitable manner to achieve the desired number of (e.g., three or more) degrees of freedom. Proximal arm portion 30A may be pivotally coupled to personnel basket 14A at joint 31. Personnel basket 14A may be mounted to boom 14B which may in turn be mounted to a main portion 14C of a vehicle. Alternatively, as shown in FIG. 2B, articulated arm 30 may be coupled to boom 14B via joint 31 without personnel basket 14A.

Figure 3:
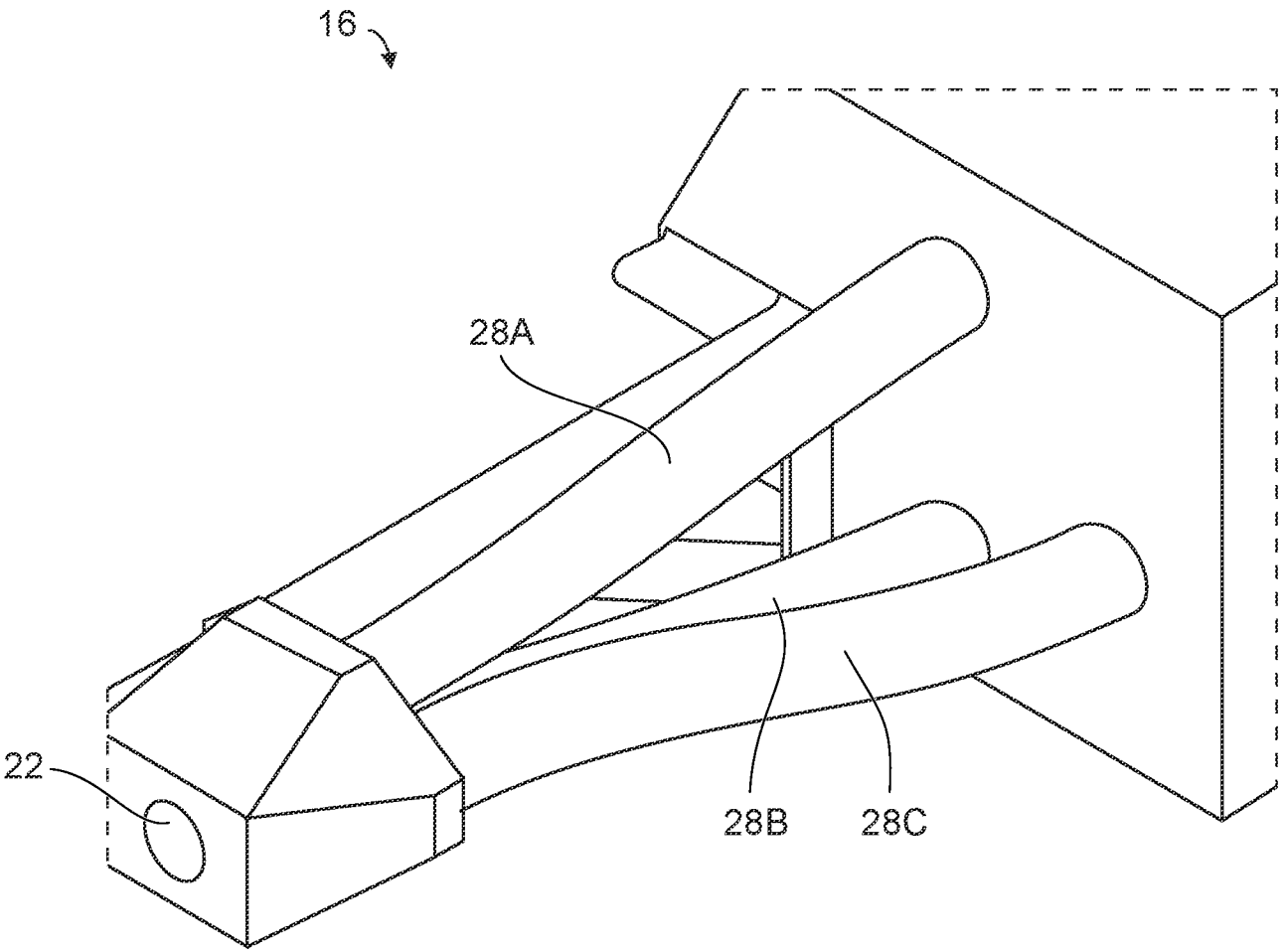
FIG. 3 is a perspective view of a forward portion of an exemplary feed unit of the apparatus of FIG. 1.

FIG. 3 is a perspective view of a forward portion of feed unit 16 of apparatus 10. As explained above, feed unit 16 may comprise separate tool guides 28A-28C associated with each tool station 20 for separately guiding each tool 18 toward common tool outlet 22.

Figure 4:
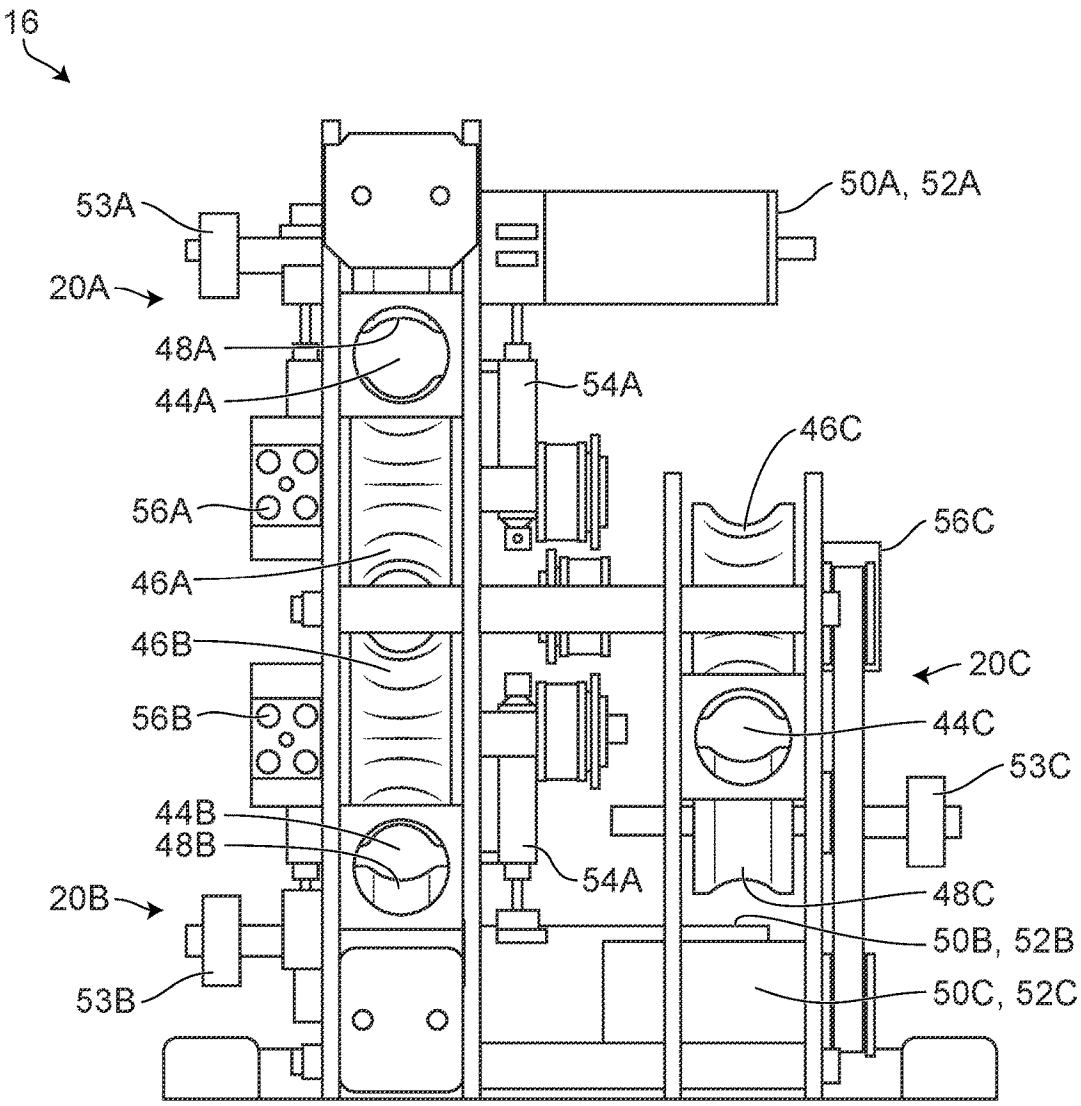
FIG. 4 is a front view of an exemplary embodiment of an interior of the feed unit of FIG. 3.
Figure 5:
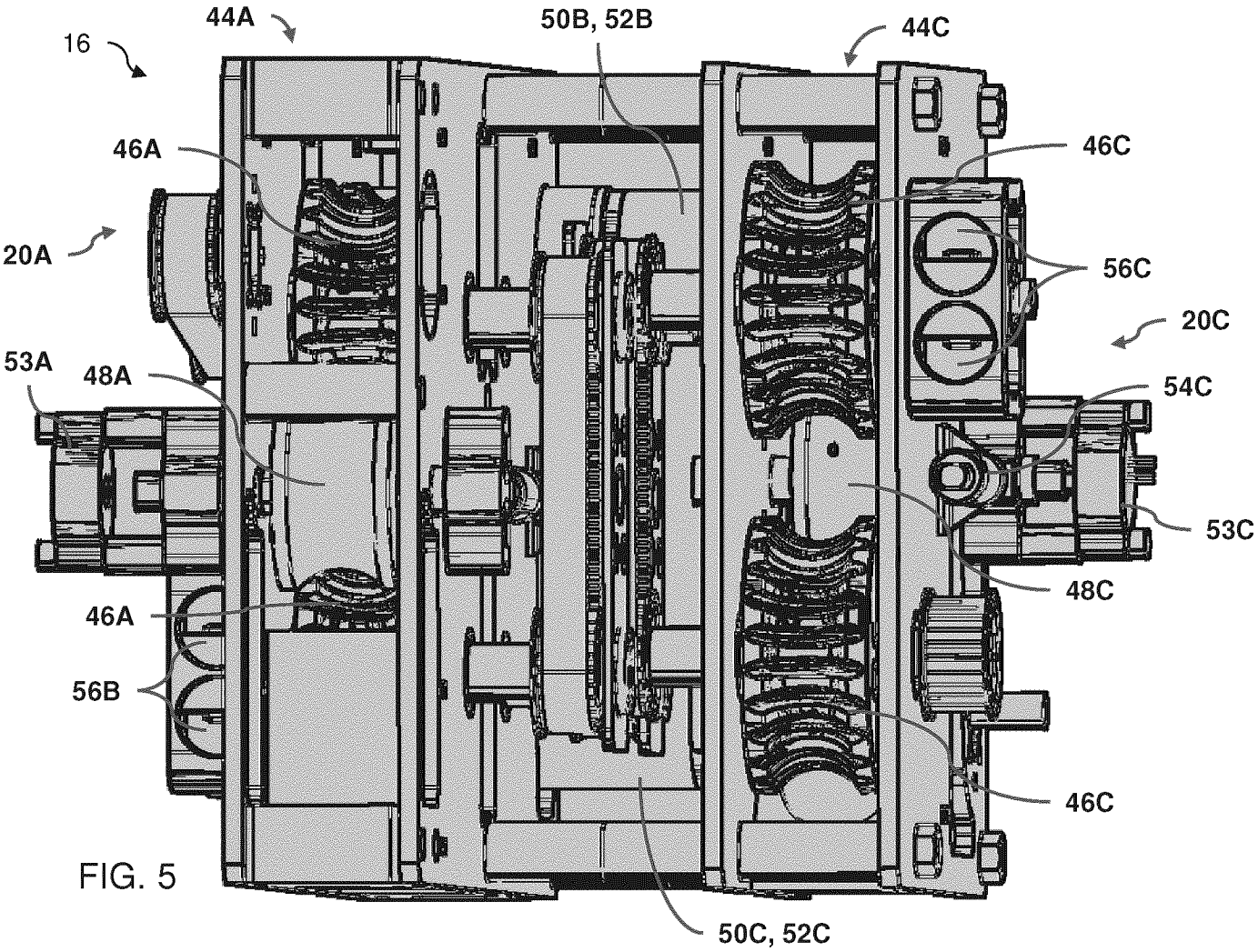
FIG. 5 is a perspective view of the interior of the feed unit of FIG. 3 showing a top side thereof.
Figure 6:
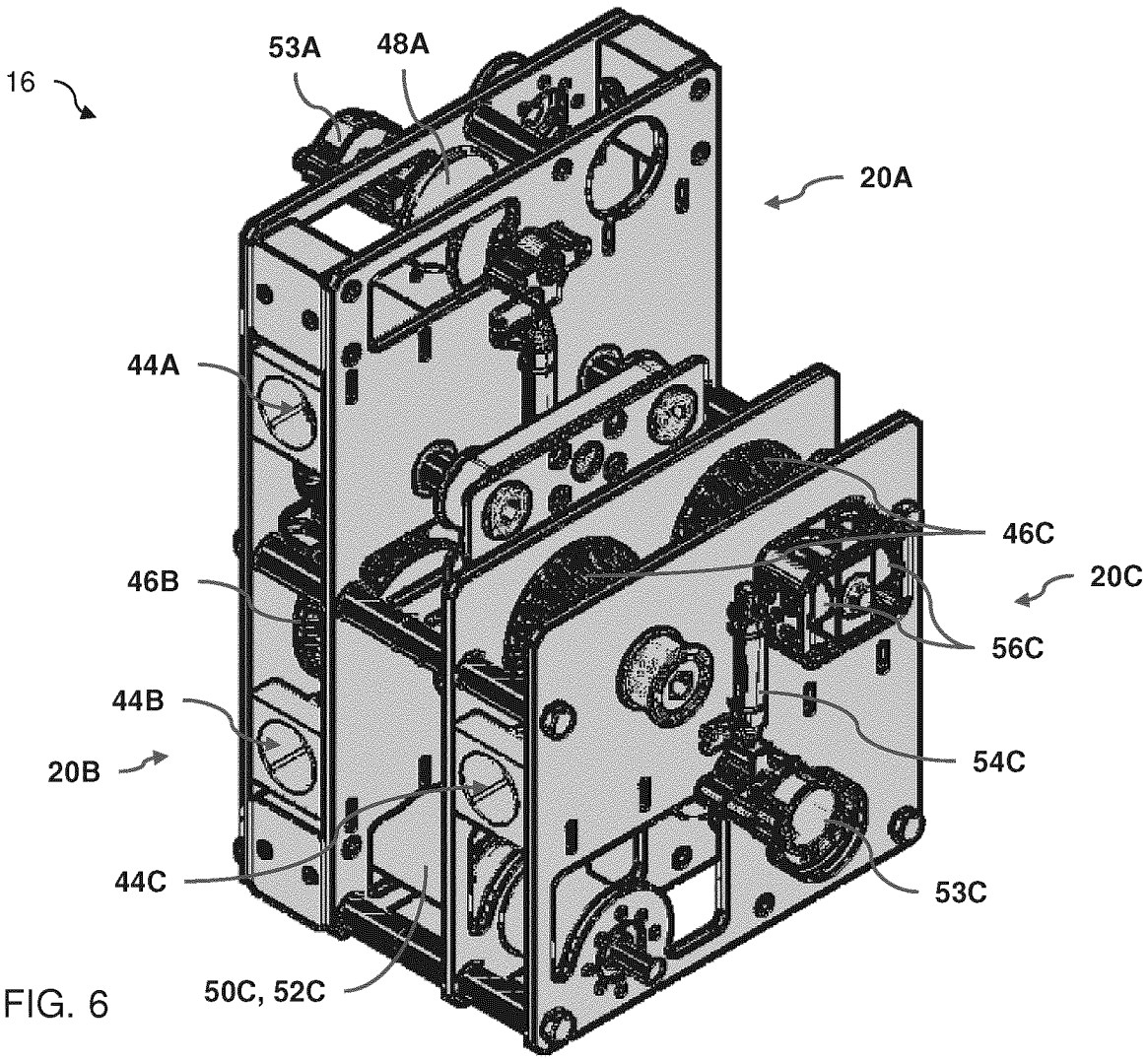
FIG. 6 is a another perspective view of the interior of the feed unit of FIG. 3.
Figure 7:
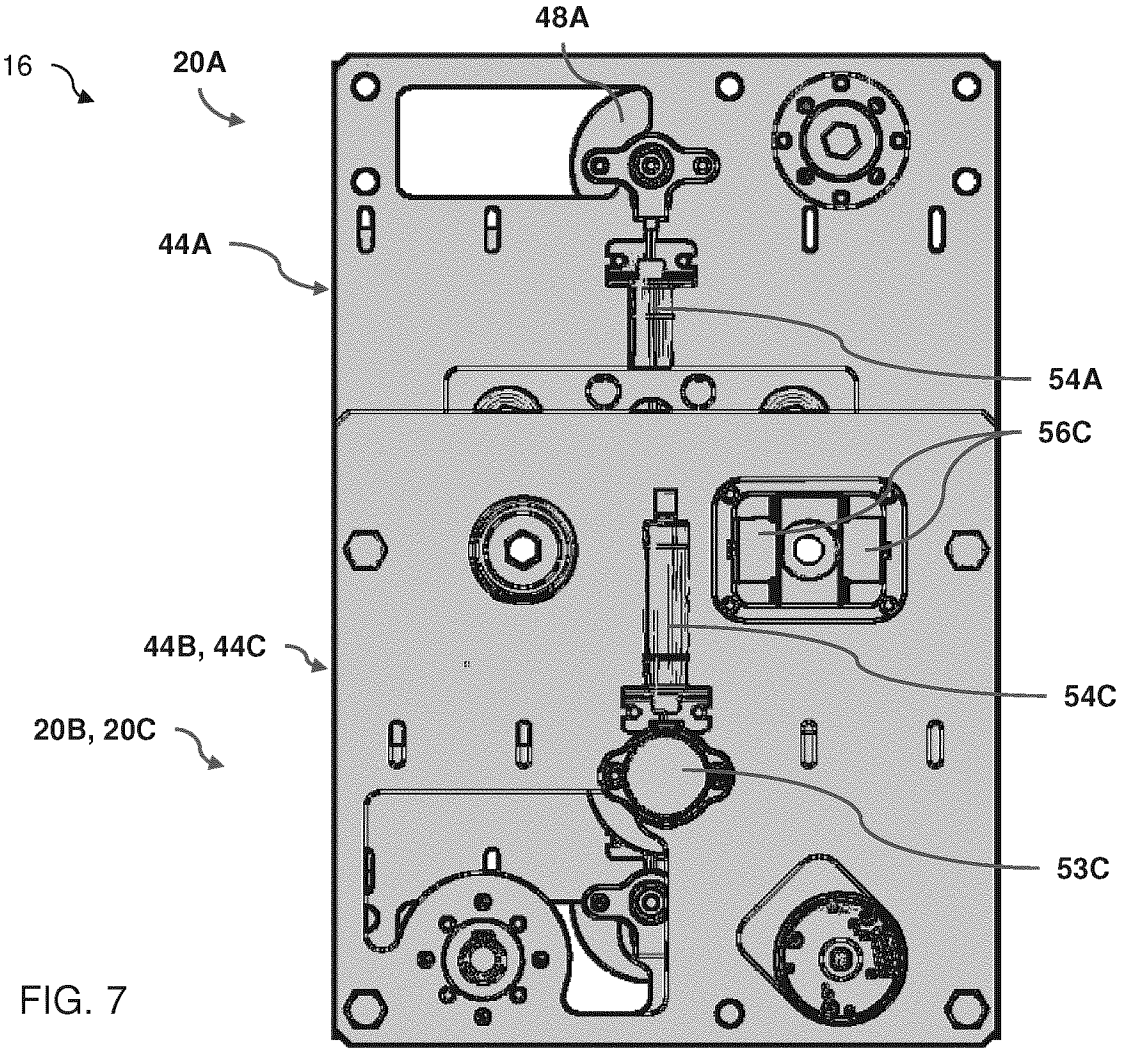
FIG. 7 is a right side view of the interior of the feed unit of FIG. 3.

FIG. 4 is a front view of an exemplary embodiment of an interior of feed unit 16. FIGS. 5 and 6 are perspective views of the interior of feed unit 16. FIG. 7 is a right side view of the interior of feed unit 16. In the exemplary embodiment, feed unit 16 comprises three tool stations 20A-20C. In some embodiments, each tool station 20 may be configured to be structurally and functionally substantially identical. Alternatively, one or more tools stations 20 may be configured differently from one or more other tool stations 20.

In reference to FIGS. 4-7, since tool stations 20 illustrated herein are substantially functionally identical, reference numerals of corresponding elements of each tool station 20 are shown with a trailing character of A, B or C corresponding to tool stations 20A, 20B and 20C respectively. Each tool station 20 may comprise tool passage 44 through which a corresponding tool 18 may be received. It is understood that feed unit 16 may be operated with one tool 18 occupying each tool station 20 but it is not necessary that every tool station 20 to be occupied by a respective tool 18 during operation (i.e., some tool station(s) may be unused). Each tool station 20 may comprise a drive mechanism that may serve to propel a respective tool 18 to either deploy or retract the respective tool 18. For example, such drive mechanism may be configured to propel tool 18 both in a deployment direction toward blast hole 12 and also in a retracting direction away from blast hole 12.

In some embodiments, the drive mechanism may comprise one or more drive wheels 46 and one or more idler wheels 48. In the exemplary embodiment illustrated, the drive mechanism comprises two drive wheels 46 disposed at different longitudinal positions along tool passage 44 and on a same side of tool passage 44. In the exemplary embodiment illustrated, the drive mechanism comprises one idler wheel 48 that is disposed at a longitudinal position between the two drive wheels 46 and on an opposite side of tool passage 44. Drive wheels 46 and idler wheel 48 may be configured to receive the respective tool 18 therebetween and engage with the respective tool 18 while driving the respective tool 18. Idler wheel 48 may be resiliently biased toward tool passage 44 in order to urge respective tool 18 against drive wheel(s) 46 when tool 18 is disposed in tool passage 44. Each tool station 20 may have a motor 50 associated therewith for driving the one or more corresponding drive wheels 46. For example, each motor 50 may be drivingly coupled to both drive wheels 46 of each tool station 20 via suitable power transmission means. For example, motor 50 may be drivingly coupled to the two associated drive wheels 46 via one or more suitable belts and pulleys as illustrated. Some motors 50 and associated power transfer means have been omitted from FIGS. 4-7 for clarity.

In some embodiments, motors 50 may be an electric motor or other suitable type of motor 50 (e.g., hydraulic or pneumatic) operatively coupled to controller 34. In some embodiments, each motor 50 may have its own (e.g., rotary) encoder 52 associated therewith to permit controller 34 to monitor and control the rotary position and speed of each motor 50. Each motor 50 may have the capability to operate at variable speeds. Such encoder 52 may permit a deployed distance of tool 18 to be measured and provided to controller 54 and/or output to mining personnel via display device 38 for example. The deployed distance of tool 18 obtained via encoder 52 may be used to determine a total depth of blast hole 12 or a distance inside blast hole 12 to which tool 18 has been deployed. This information may be used by controller 34 or maintenance personnel to control some aspect of operation of apparatus 10. For example, such information may be useful in controlling the filling of blast hole 12 with the explosive substance by controlling the position of the explosive delivery hose and coordinating the injection of the explosive substance accordingly. The use of encoder 52 may permit controller 54 to control the speed at which tool 18 is deployed or retracted. In some embodiments, suitable tool deployment/retraction speed limit may be set via software in controller 34. In some embodiments, such speed limit may be set to about 1.5 m/s for example.

One or more of tool stations 20 may be configured to accommodate tools 18 of different cross-sectional size (e.g., diameter). For example, each tool station 20 may be configured to accommodate tools 18 having an outside diameter ranging between about 1.5 cm (⅝ inch) to about 3.8 cm (1.5 inch). In some embodiments, one or more of tool stations 20 may be configured to accommodate tools 18 having an outside diameter ranging between about 5 cm (2 inch) to about 7.6 cm (3 inch). In some embodiments, one or more of tool stations 20 may be configured to accommodate tools 18 having an outside diameter of about 15 cm (6 inches). In some embodiments, one or more of tool stations 20 may be configured to accommodate tools 18 having an outside diameter of up to about 30 cm (12 inches).

In various embodiments, feed unit 16 in conjunction with controller 34 may be configured to prevent a driving force exerted on one or more tools 18 from exceeding a predetermined value when one of tools 18 is deployed or retracted. In other words, controller 34 may be configured to control feed unit 16 based on haptic feedback. Such functionality may be used to prevent causing damage to a tool 18 that has encountered an obstacle during deployment or retraction. This functionality may also be useful for using feed unit 16 in conjunction with an explosive delivery hose which may be used to deliver a detonator to the bottom of blast hole 12 for example. In some embodiments, feed unit 16 may be configured to limit a driving force to a level which would not cause damage to or cause inadvertent/accidental activation of a detonator in case the explosive delivery hose was to encounter an obstacle during deployment for example. In some embodiments, such driving force limit may be set via software in controller 34 to about 133 N (30 lbs) for example. As explained below, apparatus 10 may comprise a plurality of redundant systems for preventing feed unit 16 from exceeding such driving force limit. The use of such multiple redundant systems may permit feed unit 16 to safely operate with an explosive delivery hose as a tool 18 and an associated detonator.

One first of such system may be configured to permit slipping of the drive mechanism of a tool station 20 relative to the respective tool 18 when an obstacle is encountered by tool 18 and movement of tool 18 in the direction in which tool station 20 is propelling tool 18 is resisted by such obstacle. For example, the drive mechanism may be configured to exert a calibrated gripping force on the respective tool 18. The drive mechanism may be configured so that the gripping force may be selectively applied or released via controller 34 for example to permit the loading and unloading of tools 18 into/from tool station 20. For example, in some embodiments, idler wheel 48 may be movably (e.g., translatable) via a suitable actuator for applying and removing the gripping force.

The gripping force may be calibrated to cause slipping of the drive mechanism relative to the respective tool 18 to prevent the exertion of a driving force on the respective tool 18 that exceeds a predetermined value. In the embodiment illustrated, the calibrated gripping force may be provided by the biasing of idler wheel 48 toward tool passage 44. For example, such biasing may be provided by a suitably calibrated urging device such as a spring. In some embodiments, such urging device may comprise an air cylinder 54 (i.e., air spring) in communication with a source of pressurized air via a suitable pressure regulator for example. In some embodiments, the urging device may be configured to be selectively activated in order to selectively grip or release the respective tool 18 in the respective tool station 20. For example, the urging device may be a spring that may be manually tensioned to apply the desired calibrated gripping force. Alternatively, the urging device may be air cylinder 54 operatively coupled to a pressure control device suitable for selectively applying/releasing the pneumatic pressure to or from air cylinder 54.

In some embodiments, apparatus 10 may be configured to detect such slipping that may occur due to the calibrated gripping force as an indication of some obstacle having been encountered by tool 18. For example, in addition to encoder 52 measuring the angular position of an output shaft of motor 50 that is drivingly coupled to drive wheels 46, another encoder 53 may be operatively coupled to idler wheel 48 in order to measure an angular position of idler wheel 48. Readings from both encoder 52 and encoder 53 may be used to determine deployment distances perceived by drive wheels and by idler wheel 48 and thereby determine whether slipping of drive wheel 46 has occurred. Controller 34 may be operatively coupled to encoder 52 and to encoder 53 and be configured to, using signals from both encoders 52 and 53, detect slipping of the drive wheel 46 relative to the respective tool 18.

In combination with the calibrated gripping force permitting slipping, apparatus 10 may be configured to make use of one or more additional means for monitoring the driving force and preventing an excessive driving force to be applied to tool 18. For example, as explained below, feed unit 16 may comprise one or more first sensors configured to measure a first parameter representative the driving force exerted on the respective tool 18 and one or more second sensors configured to measure a second parameter representative the driving force exerted on the respective tool 18. Controller 34 may be operatively coupled to motor 50, to the first sensor(s) and to the second sensor(s), and configured to, based on feedback from the first and/or second sensors, substantially prevent motor 50 from exerting a driving force on the respective tool 18 that exceeds the predetermined value.

For example, a second of such system for preventing a driving force exerted on one or more tools 18 from exceeding the predetermined value may be configured to monitor a reaction force on one or more of drive wheels 46 that is indicative of the driving force exerted on the respective tool 18 by drive wheel 46 and stopping driving of the respective tool 18 before the reaction force exceeds an appropriate predetermined limit. This may be achieved via one or more load cells 56 coupled to drive wheel 46 and configured to measure a reaction force on drive wheel along a direction that is substantially parallel to tool passage 44. In some embodiments, such load cell(s) 56 may be coupled to a bearing holder of drive wheel 46. In some embodiments, such load cell(s) 56 may be configured to measure positive and negative reaction forces representative of deployment and retraction forces respectively. Load cell(s) 56 may be operatively coupled to controller 34 so that controller 34 may monitor such reaction force and either shut down or otherwise control motor 50 to prevent the application of an excessive driving force on tool 18 during deployment and/or during retraction of tool 18 based on such force feedback.

An exemplary third system for preventing a driving force exerted on one or more tools 18 from exceeding a predetermined value may be configured to monitor an output torque of motor 50 and either stopping or otherwise controlling motor 50 before the output torque exceeds an appropriate predetermined limit.

Figure 8A:
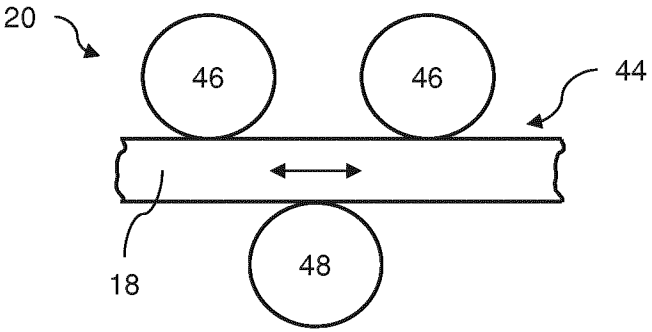
FIGS. 8A-8C are schematic illustrations of exemplary configurations of tool stations of the feed unit of FIG. 3.
Figure 8B:
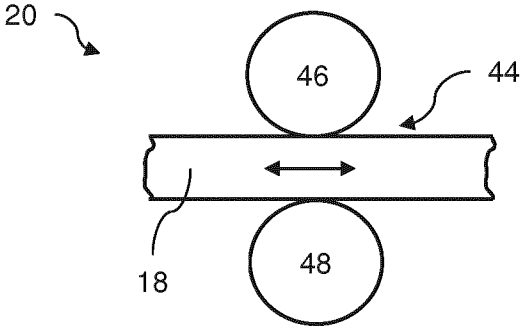
Figure 8C:
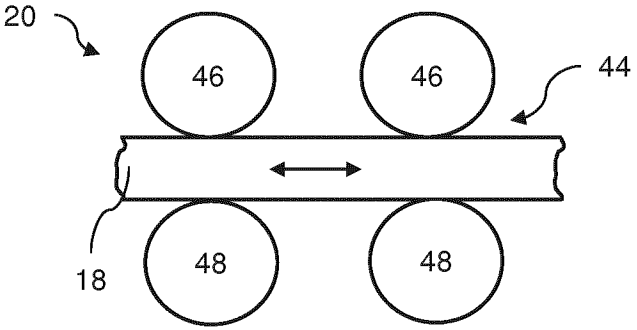

FIGS. 8A-8C are schematic illustrations of exemplary configurations of tool stations 20. In each exemplary configuration, idler wheel(s) 48 may be resiliently biased to urge tool 18 against drive wheel(s) 46. Alternatively drive wheel(s) 46 may be resiliently biased to urge tool 18 against idler wheel(s) 48. In any case, idler wheel(s) 48 and drive wheel(s) 46 may be configured to apply a calibrated gripping force on tool 18 as explained above. FIG. 8A shows, in accordance with FIGS. 4-7, a configuration including two drive wheels 46 disposed at different longitudinal positions along tool passage 44 and on a same side of tool passage 44, and, one idler wheel 48 that is disposed at a longitudinal position between the two drive wheels 46 and on an opposite side of tool passage 44. FIG. 8B shows an alternative configuration including a single drive wheel 46 and a single idler wheel 48 disposed at substantially the same longitudinal position along tool passage 44 and on opposite sides of tool passage 44. FIG. 8C shows another alternative configuration including two sets of opposed drive wheel 46 and idler wheel 48 disposed at different longitudinal positions along tool passage 44. Other configurations including more than two sets of opposed drive wheels 46 and idler wheels 48 may also be suitable.

Figure 9:
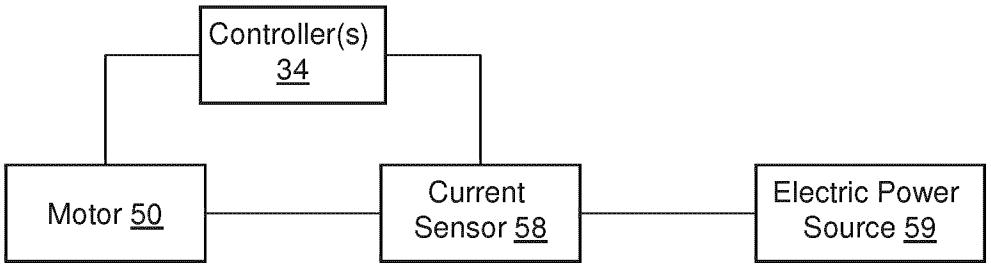
FIG. 9 is a schematic representation of an exemplary system for monitoring and limiting an output torque of a motor of the feed unit of FIG. 3 using a current sensor.

FIG. 9 is a schematic representation of an exemplary system for monitoring and limiting an output torque of motor 50 of feed unit 16 using current sensor 58. For example, apparatus 10 may be configured to prevent electric motor 50 from drawing an amount of current over a current limit correlated to the predetermined value of the driving force exerted on tool 18. Current sensor 58 may be configured to measure a current draw of motor 50 from a suitable electric power source 59. Current sensor 58 may be operatively coupled to controller 34 so that controller 34 may monitor such current draw and either shut down or otherwise control motor 50 to prevent the application of an excessive driving force on tool 18 during deployment and/or during retraction of tool 18 based on such motor load monitoring.

Figure 10:
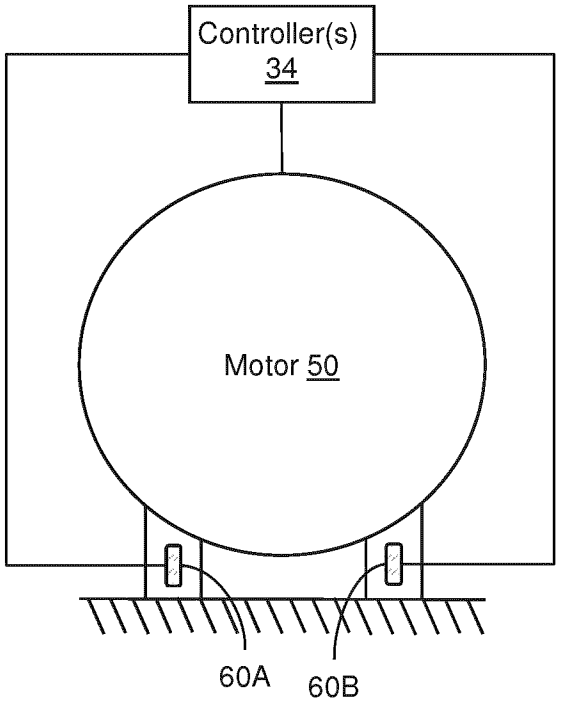
FIG. 10 is a schematic representation of another exemplary system for monitoring and limiting an output torque of a motor of the feed unit of FIG. 3 using two strain gauges.

FIG. 10 is a schematic representation of another exemplary system for monitoring and limiting an output torque of motor 50 of feed unit 16 using one or more strain gauges 60A, 60B mounted to one or more mounts of motor 50. For example, two suitable strain gauges 60A, 60B may be mounted to provide signals representative of an output torque of motor 50. For example, the two strain gauges 60A, 60B may be mounted on opposite sides of (i.e., offset from) a center of rotation of motor 50 and a difference in strain measurements between the two strain gauges 60A, 60B may be correlated to the magnitude and direction of the output torque of motor 50.

Figure 11:
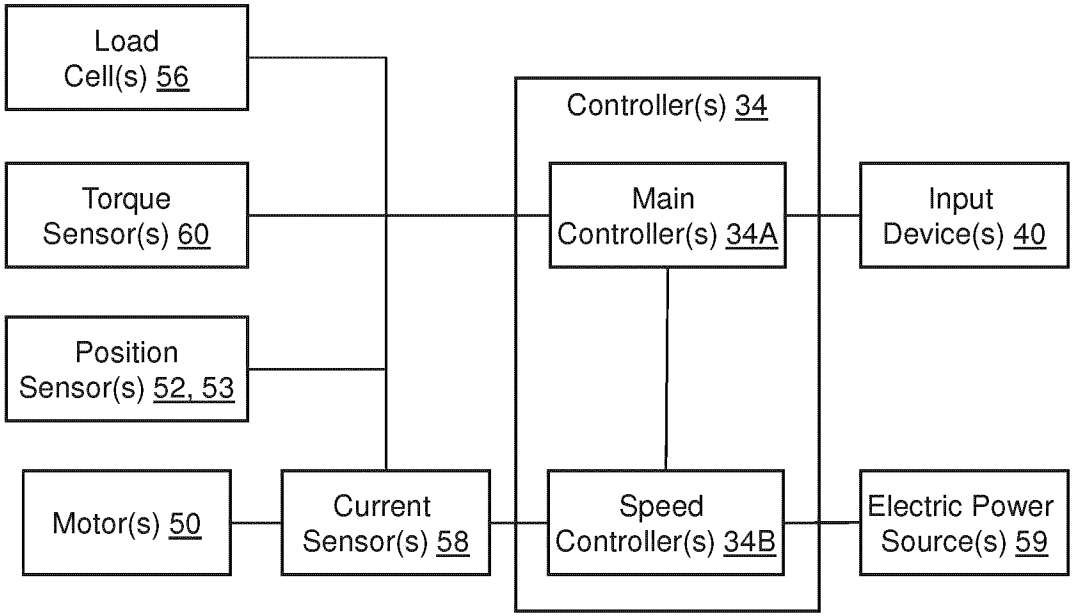
FIG. 11 is a schematic representation of an exemplary integration of a controller of the apparatus of FIG. 1 with a motor and redundant haptic sensors.

FIG. 11 is a schematic representation of an exemplary integration of controller(s) 34 with motor 50 and redundant haptic sensors for controlling the deployment and retraction of tool 18 and promoting the safe loading of explosive in blast hole 12 and also promoting the uniformity of the column of explosive substance loaded into blast hole 12 as explained above. Controller 34 may comprise a plurality of controllers networked together. For example, controller 34 may comprise main controller 34A and speed controller 34B. Main controller 34A may be part of an outer control loop receiving input signals from input device 40 and receiving feedback signals from one or more sensors such as torque sensor(s) 60 (e.g., strain gages 60A, 60B of FIG. 10), position sensor(s) such as encoders 52, 53 of FIGS. 4-7, current sensor(s) 58 of FIG. 9 and/or load cells 56 of FIGS. 4-7. The feedback signals provided to main controller 34A may be provided from a plurality of different sources which may be different sensors of different types in order to provide redundant haptic sensing and promote the safe deployment and retraction of an explosive loading tool 18 as explained above. Based on such input signals and redundant haptic feedback signals, main controller 34A may be configured to send suitable commands to speed controller 34B (i.e., inner control loop) for the purpose of controlling the operation (e.g., speed) of motor 50. In some embodiments, speed controller 34B may be configured for suitable proportional, integral and derivative (i.e., PID) control of motor 50. Even though FIG. 11 illustrates an electric motor 50, it is understood that controller 34 could instead be integrated with hydraulic or pneumatic motor(s) to provide equivalent functionality.

Figure 12C:
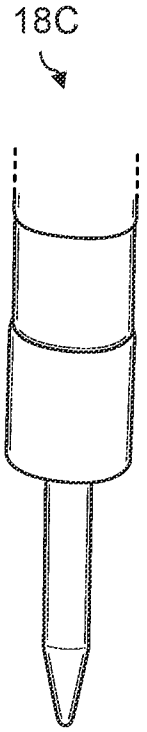
FIGS. 12A-12E are photographs of exemplary tools that may be used with the apparatus of FIG. 1.
Figure 12B:
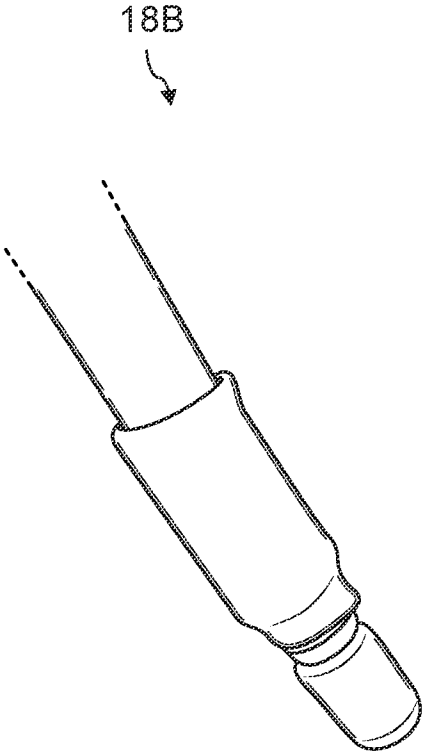
Figure 12A:
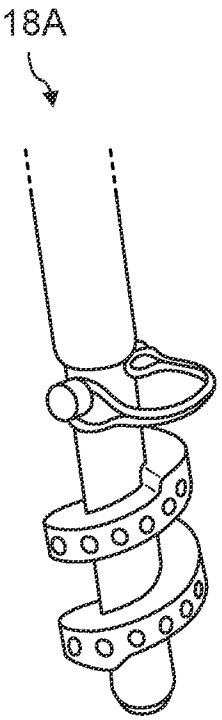
Figure 12E:
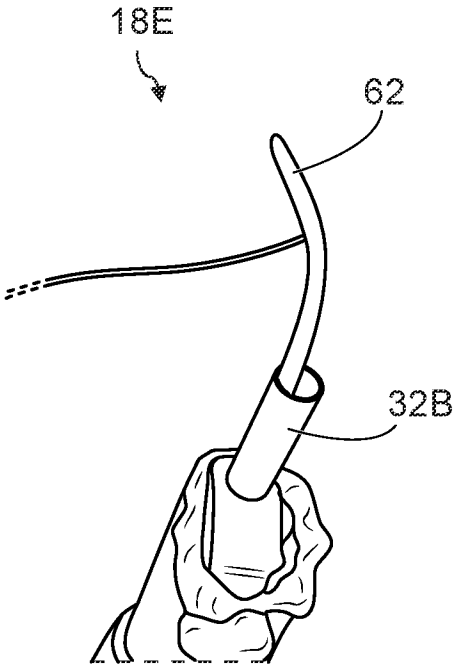
Figure 12D:
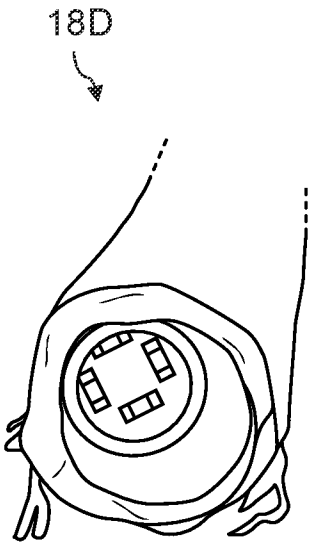

FIGS. 12A-12E are photographs of exemplary tethered tools 18 that may be used with apparatus 10. FIG. 12A shows an exemplary auger tool 18A. FIG. 12B shows an exemplary air flushing tool 18B for use with a source of compressed air. FIG. 12C shows an exemplary impact tool 18C. FIG. 12D shows an exemplary endoscope 18D. FIG. 12E shows an exemplary explosive delivery tool 18E (e.g., explosive delivery hose) with detonator 62 mounted thereto in preparation for inserting detonator 62 into blast hole 12. Tools 18 disclosed herein may be individually tethered as described above for use with feed unit 16 (see FIG. 1). However, it is understood that tools 18 disclosed herein do not have to be individually tethered and may be mounted to an articulated (e.g., micro arm) arm in any suitable way. In some embodiments, a plurality of tools 18 as disclosed here may be arranged in a carousel type format. In any case, tools 18 disclosed here may provide advantages in cleaning blast holes 12 in difficult conditions. It is understood that the use of apparatus 10 and tools 18 disclosed herein is not limited to blast holes 12 and may be used in conjunction with other drilled holes.

Tools 18 disclosed herein can also be configured and scaled to be used in blast holes 12 (or other drilled holes) of various sizes. For example, different embodiments of tools 18 disclosed herein can be configured for use in holes having diameters of about 2 inches (5 cm) to about 8 inches (20 cm).

Figure 13:
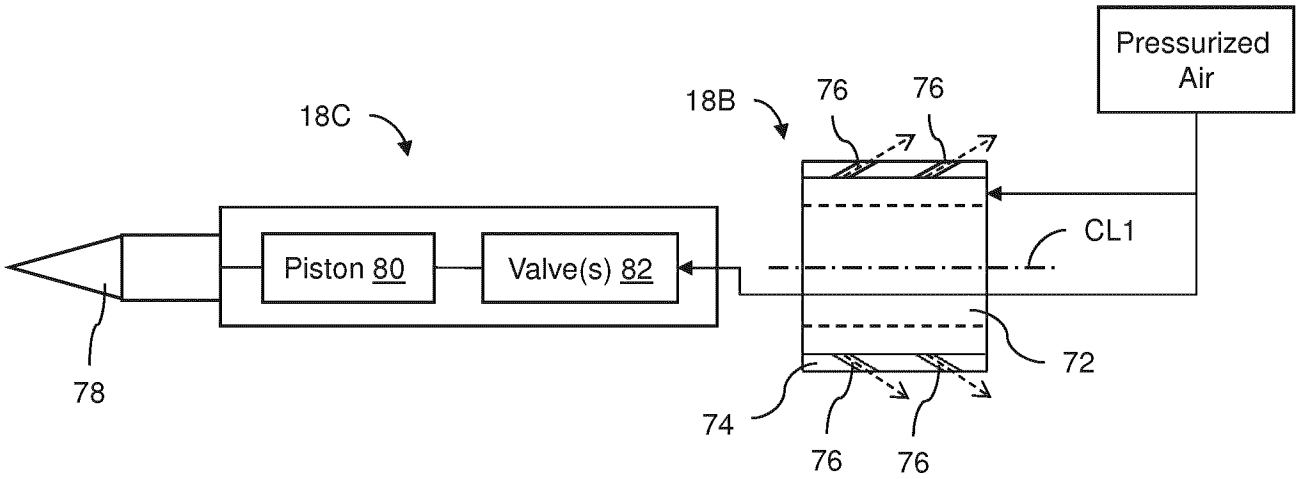
FIG. 13 is a schematic representation of an exemplary flushing tool in combination with an exemplary impact tool.

FIG. 13 is a schematic representation of an exemplary flushing tool 18B in conjunction with an exemplary impact tool 18C. It is understood that flushing tool 18B may be used alone or in conjunction with one or more other tools 18. Flushing tool 18B may assist with cleaning blast hole 12 after insertion into blast hole 12 and also as it is being retracted from blast hole 12. Flushing tool 18B may be in fluid communication with a source of pressurized air or other suitable fluid. Flushing tool 18B may comprise housing 74 defining a cavity into which pressurized air is received. A plurality of holes 76 may be formed in housing 74 for permitting the pressurized air to be discharged from housing 74 (outer wall) and impinge against an inner wall of blast hole 12. Holes 76 may be oriented in a radial and also axially rearward (i.e., proximal) direction relative to a central axis CL1 of flushing tool 18B so that loose debris inside blast hole 12 may be swept/flushed out the opening of blast hole 12 as air or other fluid is discharged from holes 76 of flushing tool 18B. In some situations the air being discharged from flushing tool 18B may serve to remove water from blast hole 12. In some embodiments, housing 74 of flushing tool 18B may have an annular shape so that it may fit over another tethered tool 18 and may be positioned and secured at any suitable axial position relative to the other tool 18. In other words, flushing tool 18B may have a sleeve configuration having a central passage 72 or other opening for receiving another tethered tool 18 therein or therethrough. It is understood that one or more flushing tools 18B may be used in conjunction with one or more other tools 18 on the same tether. In some embodiments, the pressurized air may be directed in an annular passage around the other tool(s) 18 and then be discharged from flushing tool 18B via holes 76.

In various embodiments of flushing tool 18B, for example whether flushing tool 18B is configured as in FIG. 12B with an axial discharge hole at a distal end thereof, or, is configured as in FIG. 13 with a plurality of radial/rearward discharge holes 76, the discharge of pressurized air or other fluid inside blast hole 12 may cause some loose debris at any location along blast hole 12 to be removed from blast hole 12.

For example, the flow of air or other fluid in one region inside of blast hole 12 may induce flow in other regions inside of blast hole 12 including in the annular passage between tool 18 and the inner surface of blast hole 12 by way of a Venturi effect. Therefore, flushing tool 18B may have some efficiency in cleaning blast hole 12 when flushing tool 18B is disposed at different axial positions inside of blast hole 12. The cleaning efficiency of flushing tool 18B at various axial positions may depend on factors such as the size/length of blast hole 12, the size/length of tool 18, the type, velocity and flow rate of the fluid being discharged in blast hole 12 for example. With respect to the configuration of flushing tool 18B of FIG. 13, the use of the Venturi effect combined with the air/fluid sweeping effect of discharging fluid out of holes 76 while retracting flushing tool 18B from blast hole 12 may serve to clean blast hole 12 in stages.

Impact tool 18C may comprise chisel 78 operatively coupled to piston 80. Piston 80 may be pneumatically actuated via one or more valves 82 controlling the flow of pressurized air to piston 80. In various embodiments, the configurations of impact tool 18C may be scalable such that different impact tools 18C of the same configuration but of different sizes may be manufactured to accommodate different sizes of blast holes 12. The configuration of flushing tool 18B may also have a scalable configuration so that flushing tools 18B of different sizes may be manufactured having substantially the same configuration. In various embodiments, different impact tools 18C and flushing tool(s) 18B may be configured for use with blast holes 12 of diameters ranging from 1.25 inches to 8 inches for example.

Figure 14:
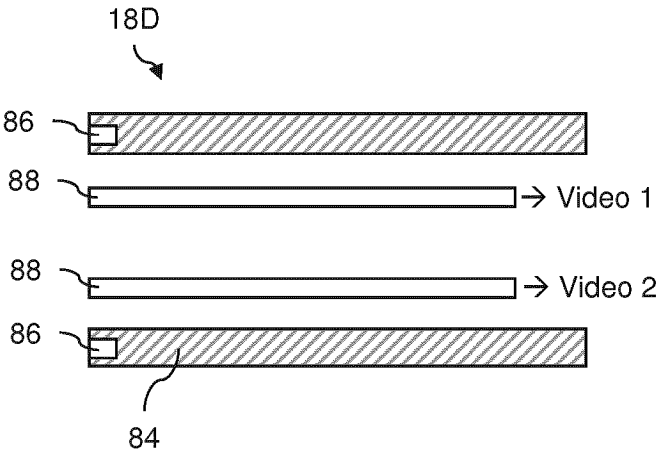
FIG. 14 is a schematic representation of an axial cross-section of a distal end of an exemplary endoscope.

FIG. 14 is a schematic representation of an axial cross-section of a distal end of an exemplary endoscope 18D that may be used for inspecting blast hole 12, monitoring or troubleshooting a task being performed by a tool 18 of apparatus 10 and/or (e.g., 3D) mapping of the interior of blast hole 12. Endoscope 18D may comprise a rigid or flexible outer tube 84, one or more light sources 86 (e.g., light-emitting diodes) for illuminating the interior of blast hole 12, two or more viewing channels 88 and associate image relay systems operatively coupled to respective digital cameras. Light sources 86 may be circumferentially distributed at the distal end of outer tube 84 of endoscope 18D. Viewing channels 88 may comprise suitable (e.g., wide angle) lenses optically coupled to optical fibers. Viewing channels 88 may be supported in a spaced-apart relationship at the distal end of endoscope 18D. The number of viewing channels 88 may vary based on the diameter of endoscope 18D such that an endoscope 18D of larger diameter may include more spaced-apart viewing channels 88 (and associated cameras) than an endoscope 18D of a smaller diameter. The use of two or more spaced-apart viewing channels 88 may optionally permit stereophotogrammetry to be carried out using images acquired via the two or more viewing channels 88 in order to permit the mapping of the interior surface of blast hole 12. Such surface mapping may be conducted according to the teachings of International Patent Publication No. WO 2013170348A1 entitled "Mapping of Mining Excavations", which is incorporated herein by reference.

For example, two or more digital images of a portion of the interior of blast hole 12 may be acquired from the different locations (vantage points) of the viewing channels 88 (e.g., Video 1 and Video 2) and stereo matching (e.g., stereophotogrammetry) may be performed using controller 34 or other data processing device(s). Images acquired using endoscope 18D may be used for live viewing (e.g., via display device 38) and/or mapping of the interior of blast hole 12 for troubleshooting for example. In some situations, digital images acquired using endoscope 18D may be used for generating digital 3D representations of blast holes 12 and/or 3D transformed images (e.g., 3D textured maps) including geological information (e.g., slips, faults, offsets) useful in geological exploration and monitoring (e.g., to troubleshoot and/or validate a geological model).

Figure 15:
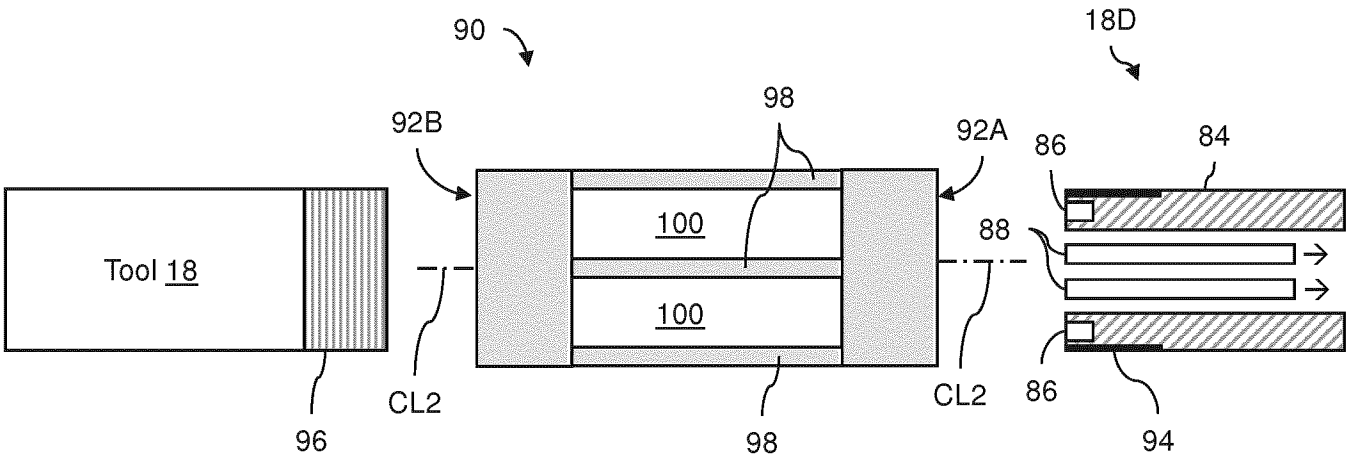
FIG. 15 is a schematic representation of an exemplary coupler for assembling the endoscope of FIG. 14 with another tool.

FIG. 15 is a schematic representation of an exemplary coupler 90 for assembling endoscope 18D with another tool 18. Coupler 90, endoscope 18D and other tool 18 are shown in a disassembled view in relation to each other. Coupler 90 may comprise first internally threaded portion 92A for engaging with externally threaded portion 94 formed on outer surface of tube 84 at a distal end of endoscope 18D.

Similarly, coupler 90 may comprise second internally threaded portion 92B for engaging with externally threaded portion 96 formed on the other tool 18. Threaded portions 92A, 92A may be located at opposite ends of coupler 90 and may be structurally coupled to each other via axial ribs 98. Axial ribs 94 may be circumferentially spaced apart about a radially-outer portion of coupler 90 and define a plurality of open slots 100 therebetween. Axial ribs 94 may be circumferentially spaced apart about central axis CL2 of coupler 90. Open slots 100 may provide radial viewing windows that are in optical communication with viewing channels 88 of endoscope 18D. For example, viewing channels 88 may include wide-angle lenses permitting viewing of the inner surface of the blast hole 12 via open slots 100 when endoscope 18D is engaged with coupler 90. It is understood that tool 18 and endoscope 18D may also be combined with flushing tool 18B as explained above.

The use of endoscope 18D in combination with another tool 18 may also be useful in monitoring, controlling or troubleshooting the task being performed using tool 18. For example, live video acquired via endoscope 18D may be relied upon by an operator of apparatus 10 for the purposed of monitoring and controlling an ongoing task. Alternatively or in addition, the video or still images may be digitally stored by data logger 41 for example for subsequent viewing/analysis.

Figure 16A:
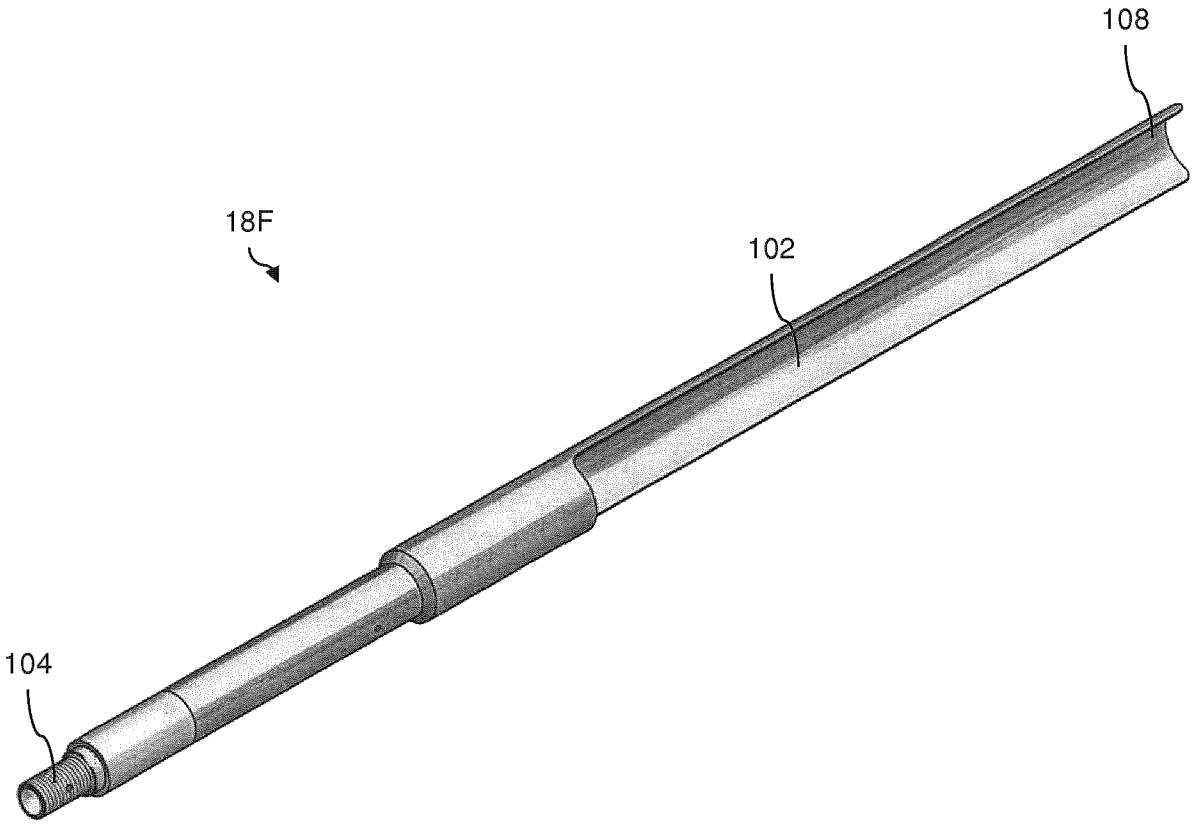
FIG. 16A is a perspective view of a tamping tool.
Figure 16B:
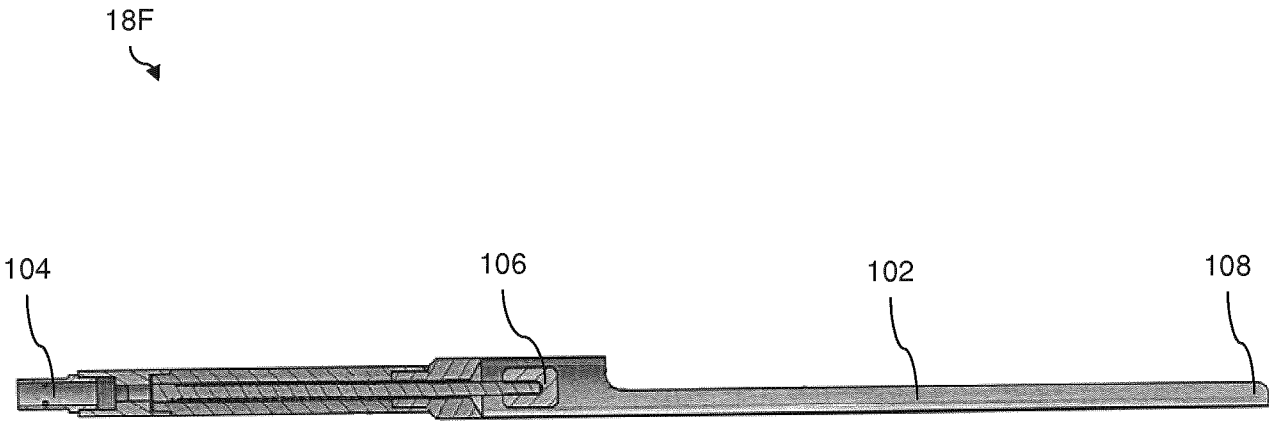
FIG. 16B is an axial cross-section of the tamping tool of FIG. 16A.

FIG. 16A is a perspective view of tamping tool 18F and FIG. 16B is an axial cross-section view of tamping tool 18F. Tamping tool 18F may be used with apparatus 10 for delivering an explosive substance to blast holes 12 or to deliver bolt resin/epoxy to drilled holes intended for the insertion of rock bolts. For example, tamping tool 18F may be configured to deliver (water-) gel explosive or other substance having a jelly-like consistency packaged in sausage-like casings (i.e., in stick form). In some embodiments, tamping tool 18F may have an elongated receiving area 102 in which a payload of one or more casings of substance are placed. Receiving area 102 of tamping tool 18F may be configured to be inserted into blast hole 12 while holding the payload.

Receiving area 102 may be inserted into blast hole 12 using articulated arm 30 of apparatus 10. For example, tamping tool 18F may be secured to a pneumatic hose at proximal end 104 of tamping tool 18F, via a threaded connection and operatively coupled to a source of pressurized air via the pneumatic hose and a valve.

Tamping tool 18F may comprise a pneumatically-actuated piston 106 or ram configured to push the payload distally so as to slide out of receiving area 102 at distal end 108 of tamping tool 18F and thereby deliver the payload of explosive to blast hole 12 for example.

Figure 17A:
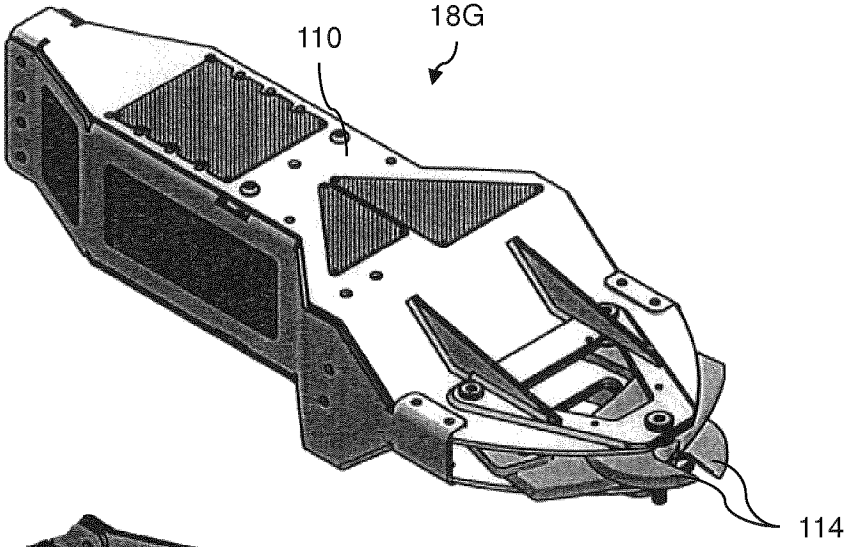
FIGS. 17A and 17B are perspective views of an exemplary shearing tool.
Figure 17B:
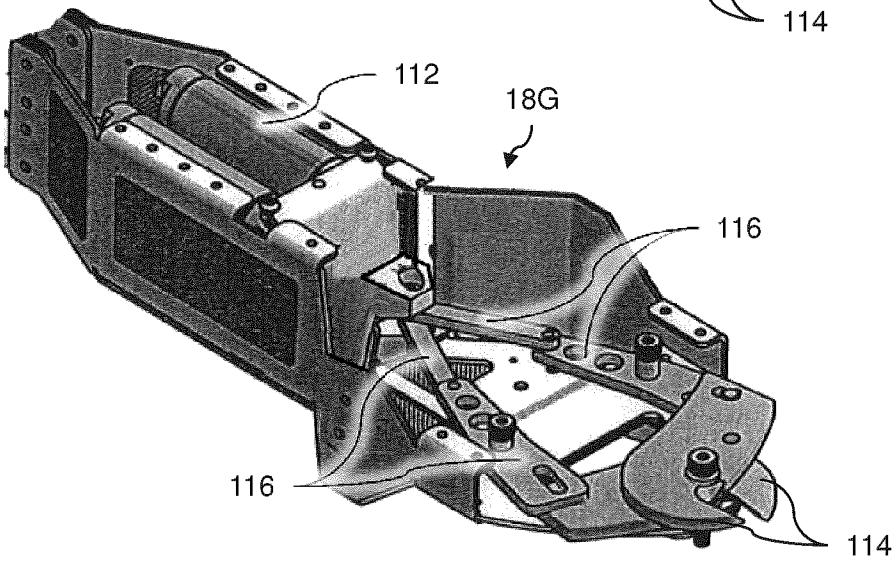

FIGS. 17A and 17B are perspective views of an exemplary shearing tool 18G that may be used with apparatus 10. Shearing tool 18G may be electrically, pneumatically or hydraulically actuated and may be tethered accordingly. FIGS. 17A and 17B show shearing tool 18G with and without top cover 110 respectively. In the exemplary embodiment shown in FIG. 17B, shearing tool 18G includes pneumatic actuator 112 operatively coupled to actuate opposing and pivotable shearing blades 114 (jaws) via suitable links 116. Links 116 may be configured to define linkages providing a suitable mechanical advantage. Shearing tool 18G may be coupled to a suitable (e.g., pneumatic) hose for use with apparatus 10 and for movement using articulated arm 30. Shearing tool 18G may be used for cutting pieces of ground control devices such as metallic screen/mesh and associated bolts for the purpose of removing pieces of such metallic screen/mesh that may have been damaged by a preceding blast.

Figure 18B:
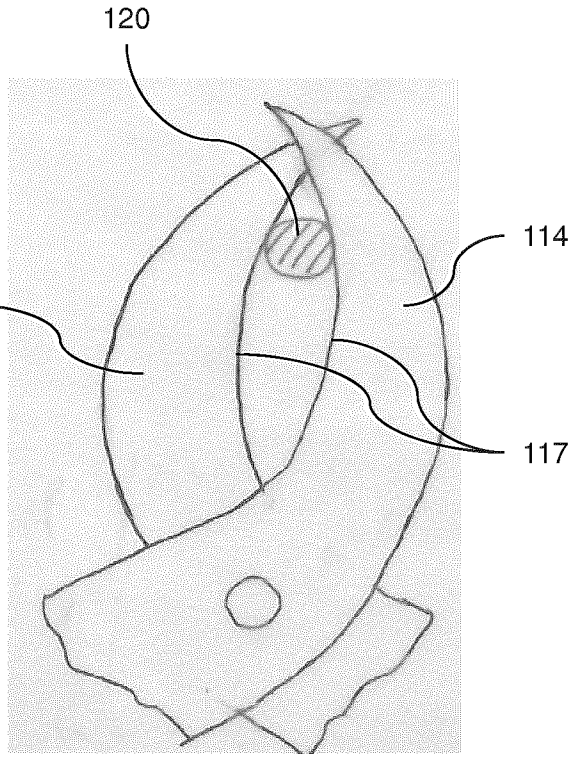
FIGS. 18A and 18B are top views of opposing blades of the shearing tool of FIGS. 17A and 17B in open and closed positions respectively.
Figure 18A:
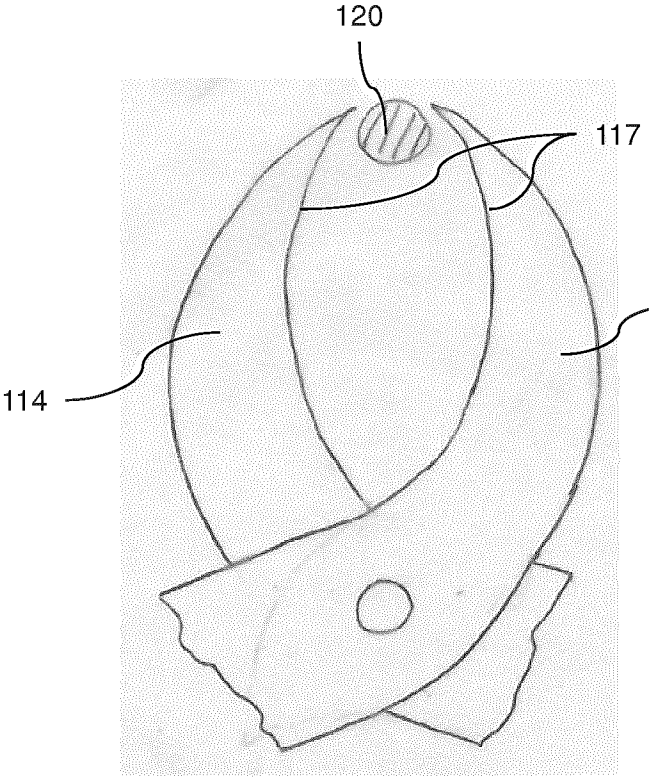

FIGS. 18A and 18B are top views of opposing blades 114 of shearing tool 18G of FIGS. 17A and 17B. FIG. 18A shows opposing blades 114 in an open configuration where bolt 120 is received between opposing blades 114. FIG. 18B shows opposing blades 114 in an more closed configuration where bolt 120 is being drawn proximally by the configuration of opposing blades 114. It is understood that further closing of opposing blades 114 would cause cutting of bolt 120. Blades 114 may each have a relatively sharp distal end and also a cutting edge 117 having a concave longitudinal profile. Such configuration of blades 114 may facilitate grabbing of a piece of screen/mesh or bolt 120 and subsequently urge the piece of screen/mesh or bolt 120 captured by blades 114 proximally into blades 114. In case of a piece of screen/mesh, the configuration of blades 114 may cause the piece of screen/mesh captured by blades 114 to be urged/pulled away from the rock surface against which the screen/mesh was previously installed. In some embodiments, shearing tool 18G may comprise one or more handles and a trigger for manual manipulation and use by an operator (i.e., standalone operation while not mounted to articulated arm 30).

Figure 19:
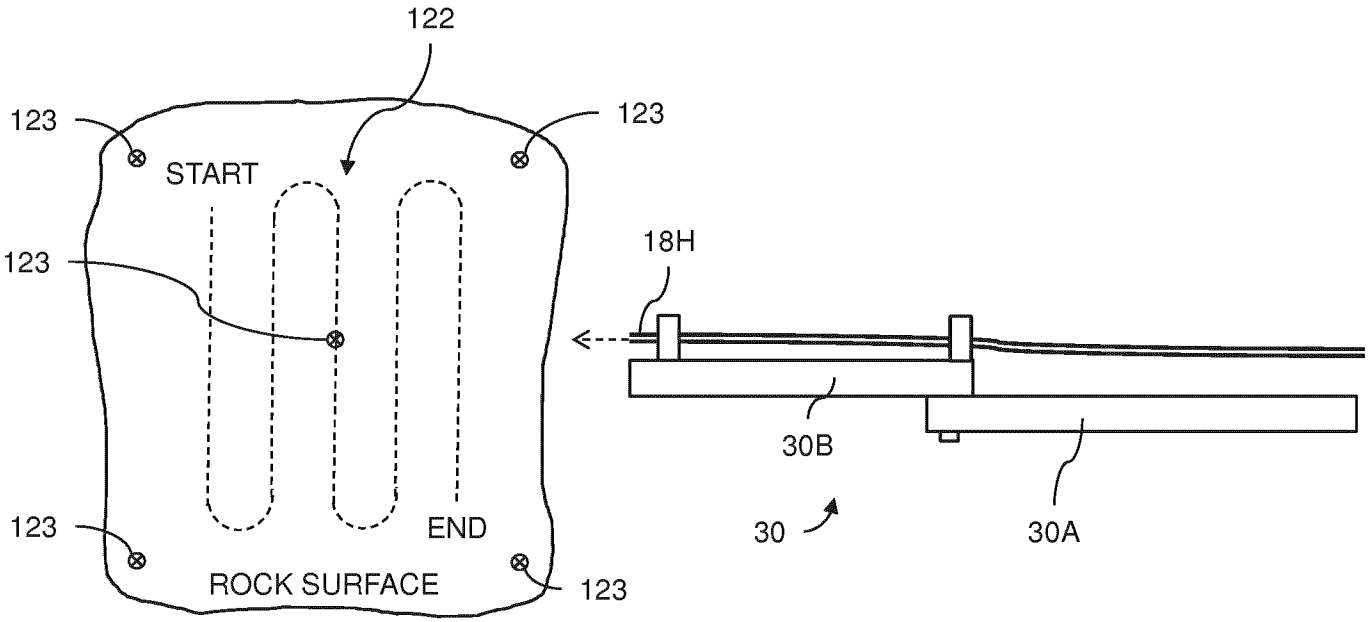
FIG. 19 is a schematic view of a spraying tool mounted to the articulated arm of the apparatus of FIG. 1 and an exemplary programmed spraying tool path.

FIG. 19 is a schematic view of spraying tool 18H mounted to articulated arm 30 of apparatus 10. Apparatus 10 may comprise one or more spraying tools 18H. For example, one spraying tool 18H may be used to spray water and/or air for cleaning (i.e., pressure washing) a rock surface (e.g., rock face, rock wall, rock ceiling) of the mining excavation. Another spraying tool 18H may be used to apply a spray-on liner on the rock surface of the mining excavation after the rock surface has been cleaned to remove dust and other loose debris to promote adherence of the spray-on liner to the rock surface. For example, spraying tool 18H may comprise a nozzle and a hose in communication with a supply of fluid (e.g., water, air, polyurethane spray-on liner material) via a suitable pump. In various embodiments, a hose associated with spraying tool 18H may be routed through feed unit 16 or routed externally to feed unit 16 and mounted in parallel to (i.e., externally) to tool delivery tubes 32A, 32B (see FIG. 1).

In some embodiments, the movement of articulated arm 30 may be controlled via manual input from an operator of apparatus 10 for real-time control of the movement by the operator. Alternatively, the movement of articulated arm 30 may be automatically controlled by controller 34 based on a predefined programmed tool path 122. The programmed tool path 122 may be configured to control a position (trajectory), travel speed and orientation of the distal end of spraying tool 18H. Programmed tool path 122 may be configured to produce substantially even or other desired distribution of material sprayed on a particular rock surface. For example, programmed tool path may be configured to produce a spray-on liner of substantially uniform thickness on the rock surface. In addition to controlling the trajectory of spraying tool 18H, programmed tool path 122 may contain instructions for controlling (e.g., turning ON or OFF) a pump and/or valve supplying the material to spraying tool 18H. In some embodiments, the programmed tool path 122 may be defined in a computer numerical control (CNC) program. It is understood that such automation of the movement of articulated arm 30 using a programmed tool path 122 may be used with other tools 18. It is understood that various configurations of tool paths 122 (e.g., overlapping circles, parallel lines, etc.) may be used for different tasks.

In some situations, it may be desirable to maintain a stand-off distance between tool(s) 18 mounted to articulated arm 30 and the rock surface with a desired range during a spraying operation. In some embodiments, the use of apparatus 10 can permit a portion of the rock surface to be at least approximately digitized so that such digitized portion can be used by controller 34 or other computing device(s) to generate a suitable tool path 122 that follows the contour of the rock surface in order to maintain a desired stand-off distance. In order to digitize the rock surface, a number of touch-off points 123 at which the distal end of tool 18 may touch the rock surface may be used as a basis for approximating an area and depth of the rock surface. In some situations it may be sufficient to use four touch-off points 123 to define four corners of an area of the rock surface to be sprayed and one touch-off point 123 somewhere inside (e.g., approximately in the middle of) the defined area to define a depth (e.g., curvature) of the rock surface. Touch-off points 123 may be used to numerically approximate a surface for preparing a suitable tool path 122 that maintains a desired stand-off distance from the rock surface. In other words, articulated arm 30 and tool(s) 18 may be used as a digitizing pencil. In some embodiments, the haptic/tactile sensing and control of the deployment and/or retraction of tool(s) 18 via tool station(s) 20 of feed unit 16 may facilitate the detection of tool(s) 18 making contact with the rock surface at desired touch-off points 123. It is understood that a greater number of touch-off points 123 may provide greater accuracy in the digitization of the portion of the rock surface.

In some embodiments, touch-off points 123 may be recorded and compared against survey points in order to compare, validate, add to and/or troubleshoot a geological model of the mining excavation. For example, the use of a known survey location of apparatus 10 combined with information acquired via sensors 39 (see FIG. 1) and/or encoders 52, 53 (see FIG. 4) may permit the locations of touch-off points 123 to be correlated with survey information of the mining excavation. Various sensors on apparatus 10 as described above may permit the attitude and tilt of articulated arm 30 to be determined and also the position of the distal tip of tool 18 to be determined. In some situations, the correlation of the position of the distal tip of tool 18 with survey information may permit touch-off points 123 on the rock surface to be imported into the 3D model (i.e., survey) of the mining excavation. In some situations, the known position(s) and/or trajectories of tool 18 can be recorded as geotechnical and planning data during spraying or any other tasks performed using any tool 18.

Figure 20:
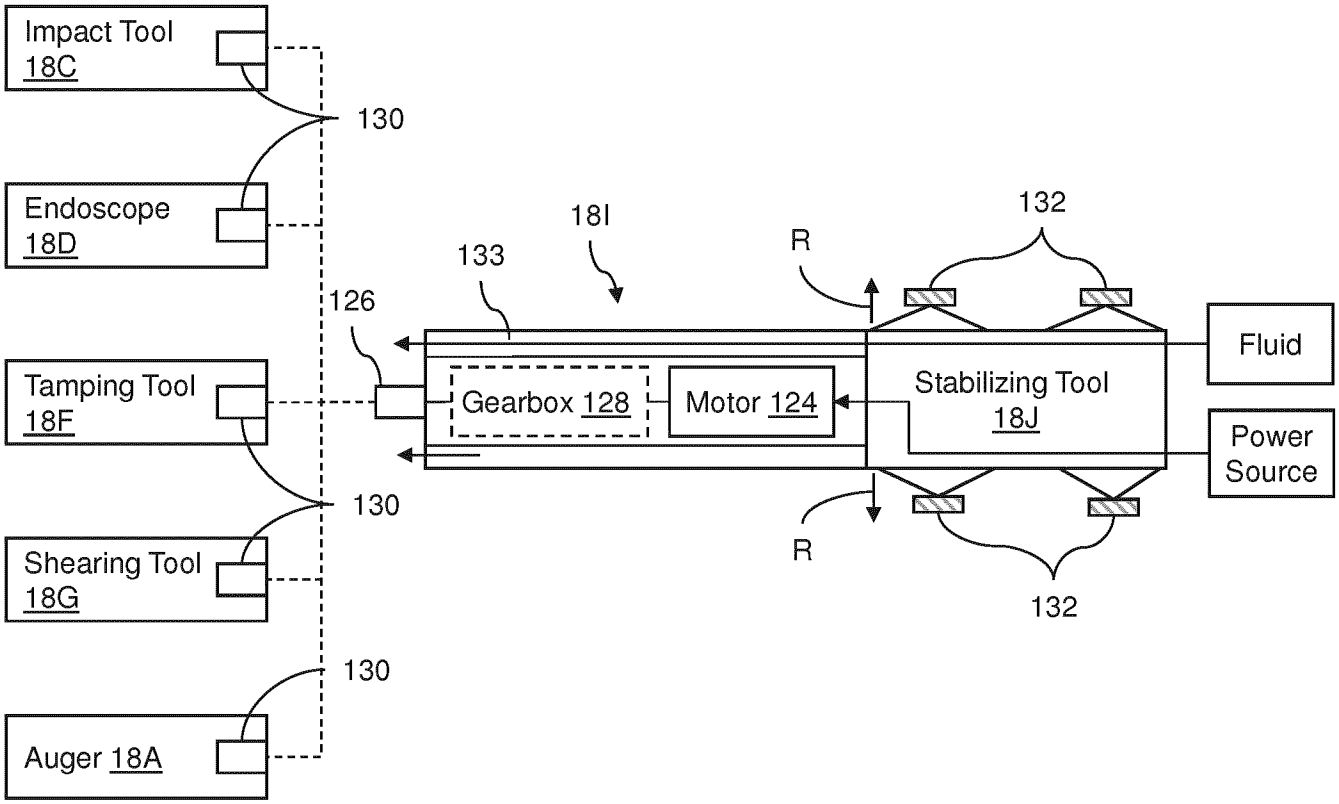
FIG. 20 is a schematic representation of a rotary driver and a stabilizing tool in combination with various other tools.

FIG. 20 is a schematic representation of rotary driver 18I and stabilizing tool 18J in combination with various other tools 18. Rotary driver 18I may comprise motor 124 operatively coupled to output shaft 126. Output shaft 126 may be configured to impart rotary motion to another tool 18. In some embodiments, motor 124 may be coupled to output shaft 126 via suitable gearbox to achieve a desired speed reduction or augmentation from motor 124. Motor 124 may be electrically, pneumatically or hydraulically powered. Motor 124 may be controlled via controller 124 or otherwise. Rotation from rotary driver 18I may be transmitted to one or more other tools 18 (e.g., impact tool 18C, endoscope 18D, tamping tool 18F, shearing tool 18G and auger 18A) by way of output shaft 126 being in torque-transmitting engagement with a corresponding receiver 130. Rotary driver 18I may be used to change/control the orientation of the other tool 18 mounted thereto during the performance of a task. In some embodiments, the operation of rotary driver 18I may be automated and pre-programmed or may be based on (e.g., real time) input from the operator.

In some embodiments, the construction of rotary driver 18I may provide a longitudinal passage 133 extending axially therethrough to permit a fluid such as pressurized air or water for example to optionally be delivered at a distal end of rotary driver 18I. In some embodiments, passage 133 may have an annular configuration and may be defined between a central body of rotary driver 18I and a sleeve disposed around and spaced apart from the central body. Accordingly, rotary driver 18I may include an annular opening at the distal end thereof through which the fluid may be discharged. Delivering a fluid out of a distal end of rotary driver 18I may assist with the performance of a task being performed using another tool 18 mounted to the distal end of rotary driver 18I. For example, while using rotary driver 18I to drive auger 18A, a flow of fluid may provide a mechanical advantage to a digging task performed with auger 18A by flushing material out of auger 18A and blast hole 12 to reduce regrinding and also by loosening material around auger 18A.

Stabilizing tool 18J may serve to stabilize or anchor rotary driver 18I during operation of rotary driver 18I to prevent a reaction torque applied to a tether of rotary driver 18I from causing backlash or otherwise negatively affecting the operation of rotary driver 18I. Stabiliazing tool 18J may comprise one or more selectively radially-deployable and retractable members 132 (e.g., pads) configured to engage an inside surface of blast hole 12. Members 132 may be selectively deployable generally radially along arrows R via a suitable actuator (e.g., electric, pneumatic or hydraulic). The deployment of members 132 may effectively clamp stabilizing tool 18J inside of blast hole 12 and stabilize rotary driver 18I by providing support for some of the reaction torque. It is understood that rotary driver 18I may be operated without the stabilizing tool 18J in some situations such as when rotary driver 18I is used with a tool 18 outside of blast hole 12.

Figure 21A:
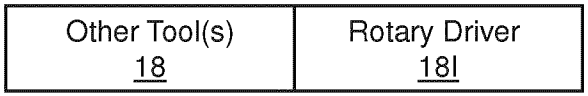
FIGS. 21A, 21B and 21C are schematic representations of the rotary driver of FIG. 20 in combination with other tools.
Figure 21B:
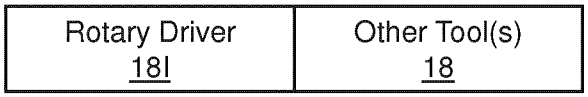
Figure 21C:
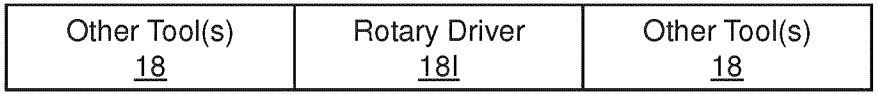

FIGS. 21A, 21B and 21C are schematic representations of rotary driver 18I of FIG. 20 in combination with other tools 18. In various situations, rotary driver 18I may be disposed proximally of one or more other tools 18 (see FIG. 21A), distally of one or more other tools 18 (see FIG. 21B) or disposed between two other tools 18 (see FIG. 21C). In reference to FIG. 21A, rotary driver 18I may be disposed proximally of (i.e., behind) impact tool 18C, endoscope 18D, tamping tool 18F or shearing tool 18G for example to vary the orientation of such other tool 18 for the performance of a desired task for example. In reference to FIG. 21B, rotary driver 18I may be disposed distally (i.e., in front) of impact tool 18C so that suitable impact may be transferred to a drill bit or auger connected to rotary driver 18I during operation (e.g., impact drilling). In reference to FIG. 21C, rotary driver 18I may be disposed proximally of (i.e., behind) another tool 18 and disposed distally (i.e., in front) of flushing tool 18B or endoscope 18D. As explained above, rotary driver 18I may or may not be operated with stabilizing tool 18J in various situations. Various tools 18 may be conectable together via suitable attachment (e.g., quick-connect) mechanisms. Some tools 18 may be connectable together with or without the use of rotary driver 18I.

Figure 22:
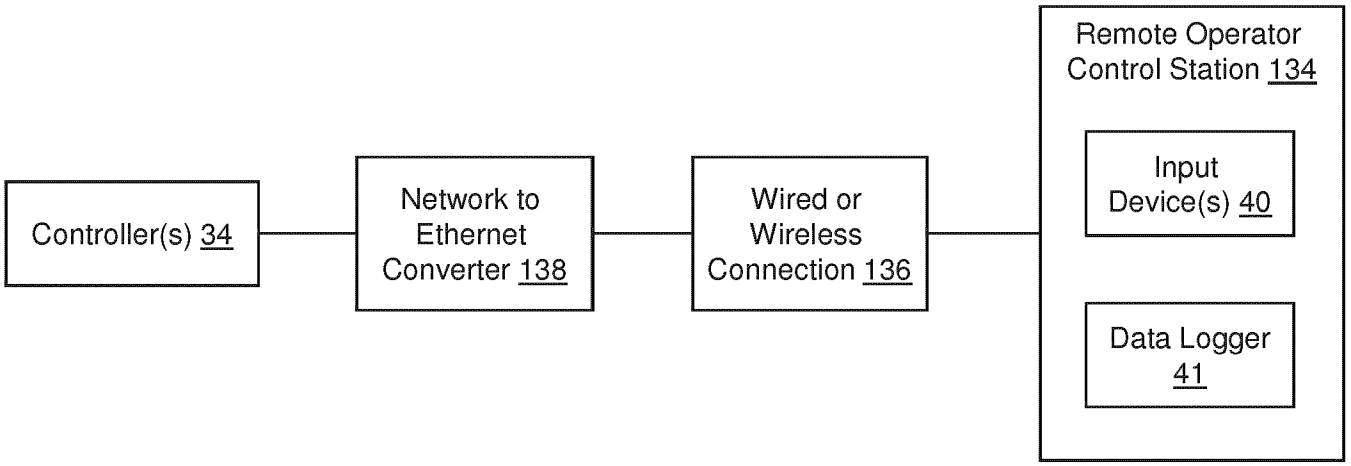
FIG. 22 is a schematic representation of an exemplary integration of the controller of the apparatus of FIG. 1 for teleoperation of the apparatus of FIG. 1.

FIG. 22 is a schematic representation of an exemplary integration of controller(s) 34 for a remotely controlled operation (i.e., teleoperation) of apparatus 10 from a remote operator control station 134. In some situations, it may be desirable to have the operator of apparatus 10 located at a location that is farther away from the rock face than available by way of structure 14 and articulated arm 30. For example, it could be desirable to have an operator of apparatus 10 located at about 30 or 40 feet away from the rock face to improve safety. In some situations, it could be desirable to have the operator located outside of a particular region of the mining excavation or to have the operator located outside of the mining excavation altogether. The ability to keep humans away from the rock face and potentially out of a particular region of the mining excavation may reduce or eliminate the need for the installation of ground control devices (e.g., screen/mesh and rock bolts) and for providing other facilities (e.g., ventilation, lighting) typically required when an underground region of a mining excavation is occupied by humans.

As explained above, controller(s) 34 may comprise one or more digital computer(s) or other data processors networked together. Controller(s) 34 may, for example, be configured to make decisions regarding the control of apparatus 10 and cause some actions to be carried out by apparatus 10 based on input from mining personnel via input device(s) 40 for example. As shown in FIG. 22, input device(s) 40 may be located at a remote operator control station 134 located remotely from controller(s) 34 and remotely from the remainder of apparatus 10. Remote operator control station 134 may be located outside of a region of the mining excavation such as at an outer edge of the workplace or outside of a corridor in which the remainder of apparatus 10 is located and operating. In some embodiments, remote operator control station 134 may be located at the surface outside of the mining excavation altogether.

In various embodiments, controller(s) 34 and input device(s) 40 may be operatively coupled together via one or more wired and/or wireless connections 136. In some embodiments a suitable network to ethernet converter 138 (module) may be disposed between controller(s) 34 and input device(s) 40. For example, controller(s) 34 may comprise a plurality of controllers, processors or other devices networked together and making use of one or more internal communication protocols/busses such as one or more of the following: Inter-Integrated circuit ($I^2C$), controller area network (CAN bus), serial bus, serial peripheral interface bus (SPI) for example. Network to ethernet converter 138 may serve as an interface for wired or wireless communication with controller(s) 34. Other suitable communication interface module may be located at remote operator station 134 for interfacing with input device(s) 40. In various embodiments, wireless communication between controller(s) 34 and input device(s) 40 may be established using 900 MHz or 2.4 GHz wireless equipment.

Wired or wireless connection 136 may be used for bidirectional communication between controller(s) 34 and remote operator control station 134. For example, input device(s) 40 may be used to send commands for controlling the operation of apparatus 10. Feedback from apparatus 10 may also be provided to remote operator control station 134 for use by mining personnel. In some embodiments, sensors operatively mounted to apparatus 10 may provide feedback on the operations performed by apparatus 10. Feedback on the tasks performed by apparatus 10 may be stored in suitable memory located at controller(s) 34 and/or at data logger 41 of remote operator control station 134. Wired or wireless connection 136 may be used to send a machine-readable program product containing instructions for execution by controller(s) 34 and for automatically controlling apparatus 10 during the performance of one or more tasks.

Figure 23:
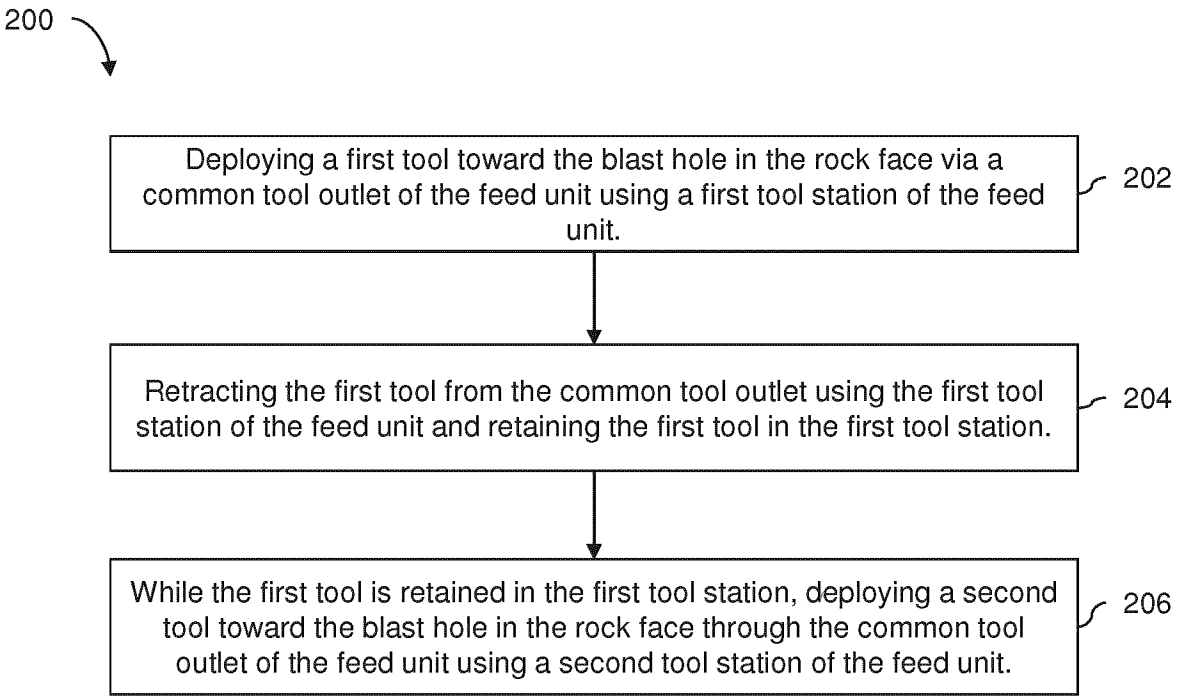
FIG. 23 is a flowchart illustrating an exemplary method for preparing a blast hole in a rock face during a mining operation.

FIG. 23 is a flowchart illustrating an exemplary method 100 for preparing blast hole 12 in a rock face during a mining operation. In various embodiments, method 100 or part(s) thereof may be carried out using apparatus 10 as described above but method 100 is not limited to the specific configuration of apparatus 10 disclosed herein.

Aspects of the above description relating to apparatus 10 are also applicable to method 100 and are not repeated. In various embodiments, method 100 or part(s) thereof may be carried out using feed unit 16 and method 100 may comprise:

deploying a first tool 18 toward blast hole 12 in the rock face via common tool outlet 22 of feed unit 16 using first tool station 20A of feed unit 16 (see block 102);

after a first operation has been performed at blast hole 12 using first tool 18, retracting first tool 18 from common tool outlet 22 using first tool station 20B of feed unit 16 and retaining first tool 18 in first tool station 20A (see block 104); and while first tool 18 is retained in first tool station 20A, deploying a second tool 18 toward blast hole 12 in the rock face through common tool outlet 22 of feed unit 16 using second tool station 20B of feed unit 16.

The above steps represented by blocks 102, 104 and 106 may be repeated any number of times with different tools 18 or with the same tools 18 as required to properly prepare blast hole 12.

In some embodiments, method 100 may comprise loading first and second tools 18 into respective first and second tool stations 20A, 20B via respective first and second tool-receiving apertures 26 disposed on a side of tool stations 20 opposite of common tool outlet 22.

In some embodiments, method 100 may comprise: guiding first tool 18 toward common tool outlet 22 when deploying first tool 18; and guiding second tool 18 toward common tool outlet 22 when deploying second tool 18.

In some embodiments, method 100 may comprise inserting detonator 62 inside blast hole 12 using second tool 18 when second tool 18 is deployed.

In some embodiments, method 100 may comprise at least partially filling blast hole 12 with an explosive substance using second tool 18 when second tool 18 is deployed.

In some embodiments, method 100 may comprise preventing a driving force exerted on first tool 18 from exceeding a first predetermined value when deploying first tool 18.

In some embodiments, method 100 may comprise exerting a first calibrated gripping force on first tool 18 when deploying first tool 18. The first gripping force may be calibrated to cause slipping to prevent the driving force exerted on first tool 20A from exceeding the first predetermined value.

In some embodiments, method 100 may comprise preventing a driving force exerted on second tool 18 from exceeding a second predetermined value when deploying second tool 18.

In some embodiments, method 100 may comprise exerting a second calibrated gripping force on second tool 18 when deploying second tool 18. The second gripping force may be calibrated to cause slipping to prevent the driving force exerted on the second tool from exceeding the second predetermined value.

In some embodiments, method 100 may comprise actively limiting an output torque of motor 50 used to deploy any one of the first tool 18 and the second tool 18.

In some embodiments, method 100 may comprise monitoring the output torque of motor 50 by monitoring an electrical current draw of motor 50.

In some embodiments, method 100 may comprise measuring a deployed distance of any one of the first tool 18 and the second tool 18.

In some embodiments, method 100 may comprise detecting a presence of any one of the first tool 18 and second tool 18 at common tool outlet 22.

In some embodiments, method 100 may comprise using a plurality of redundant systems to prevent a driving force exerted on any one of the first tool 18 and the second tool 18 from exceeding a predetermined value.

In various embodiments of method 100, the first and second tools may comprise impact tool 18C, endoscope 18D, any other tools 18 disclosed herein or other tools.

Method 100 may comprise: performing a flushing operation of blast hole 12; mapping an inside of blast hole 12 using endoscope 18D, delivering an explosive substance to blast hole 12, performing a shearing operation, performing a spraying operation, stabilizing tool 18 against an inside surface of blast hole 12, collecting a geological sample, analyzing a composition of the geological sample and/or automatically moving tool 18 along a preprogrammed tool path 122.

Method 100 may comprise rotating tool(s) 18 using rotary driver 18I. Method 100 may comprise delivering a fluid to tool(s) 18 during an operation/task.

The above description is meant to be exemplary only, and one skilled in the relevant arts will recognize that changes may be made to the embodiments described without departing from the scope of the invention disclosed. For example, the blocks and/or operations in the flowchart described herein are for purposes of example only. There may be many variations to these blocks and/or operations without departing from the teachings of the present disclosure. The present disclosure may be embodied in other specific forms without departing from the subject matter of the claims.

Also, one skilled in the relevant arts will appreciate that while the apparatus disclosed and shown herein may comprise a specific number of elements/components, the apparatus could be modified to include additional or fewer of such elements/components. The present disclosure is also intended to cover and embrace all suitable changes in technology. Modifications which fall within the scope of the present invention will be apparent to those skilled in the art, in light of a review of this disclosure, and such modifications are intended to fall within the appended claims. Also, the scope of the claims should not be limited by the preferred embodiments set forth in the examples, but should be given the broadest interpretation consistent with the description as a whole.

What is claimed is:

1. An apparatus for preparing a blast hole in a rock face during a mining operation, the apparatus comprising:

a support structure; and a feed unit supported by the support structure, the feed unit comprising a plurality of tool stations in communication with a common tool outlet, each tool station comprising a drive mechanism configured to deploy a tool out of the common tool outlet to deliver the tool to the blast hole in the rock face and to retract the tool from the common tool outlet, each tool station being configured to retain its respective tool in the tool station when the respective tool is retracted from the common tool outlet, the tool station being configured to prevent a driving force exerted on the tool from exceeding a predetermined value, the drive mechanism of the tool station being configured to exert a calibrated gripping force on the tool, the gripping force being calibrated to cause slipping of the drive mechanism relative to the tool to prevent the driving force exerted on the tool from exceeding the predetermined value.

2. The apparatus as defined in claim 1, wherein the feed unit comprises respective tool-receiving apertures for loading the respective tools into each of the tool stations, the tool receiving apertures being disposed on a side of the tool stations opposite of the common tool outlet.

3. The apparatus as defined in claim 1, wherein the feed unit comprises a tool guiding portion configured to guide each tool from its respective tool station toward the common tool outlet.

4. The apparatus as defined in claim 1, comprising at least one sensor configured to measure a deployed distance of at least one of the tools.

5. The apparatus as defined in claim 1, comprising at least one of the tools, the at least one tool being tethered for deployment using the feed unit.

6. The apparatus as defined in claim 5, wherein the tool is tethered by an electrically conductive hose.

7. The apparatus as defined in claim 1, wherein the apparatus is programmable to automatically execute a predefined tool path for the tool.

8. A feed unit for preparing a blast hole in a rock face during a mining operation, the feed unit comprising:

a first tool station in communication with a common tool outlet, the first tool station comprising a first drive mechanism configured to deploy a first tool out of the common tool outlet to deliver the first tool to the blast hole in the rock face and to retract the first tool from the common tool outlet, the first tool station being configured to retain the first tool in the first tool station when the first tool is retracted from the common tool outlet, the first tool station being configured to prevent a driving force exerted on the first tool from exceeding a predetermined value, the first drive mechanism of the first tool station being configured to exert a calibrated gripping force on the first tool, the gripping force being calibrated to cause slipping of the first drive mechanism relative to the first tool to prevent the driving force exerted on the first tool from exceeding the predetermined value; and a second tool station in communication with the common tool outlet, the second tool station comprising a second drive mechanism configured to deploy a second tool out of the common tool outlet to deliver the second tool to the blast hole in the rock face and to retract the second tool from the common tool outlet, the second tool station being configured to retain the second tool in the second tool station when the second tool is retracted from the common tool outlet.

9. The feed unit as defined in claim 8, comprising a sensor configured to measure a deployed distance of the first tool.

10. A method for preparing a blast hole in a rock face during a mining operation using a feed unit, the method comprising:

deploying a first tool toward the blast hole in the rock face via a common tool outlet of the feed unit using a first tool station of the feed unit;

after a first operation has been performed at the blast hole using the first tool, retracting the first tool from the common tool outlet using the first tool station of the feed unit and retaining the first tool in the first tool station;

while the first tool is retained in the first tool station, deploying a second tool toward the blast hole in the rock face through the common tool outlet of the feed unit using a second tool station of the feed unit;

preventing a driving force exerted on the second tool from exceeding a predetermined value when deploying the second tool; and using a plurality of redundant systems to prevent the driving force exerted on the second tool from exceeding the predetermined value.

11. The method as defined in claim 10, comprising loading the first and second tools into the respective first and second tool stations via respective first and second tool-receiving apertures disposed on a side of the tool stations opposite of the common tool outlet.

12. The method as defined in claim 10, comprising inserting a detonator inside the blast hole using the second tool.

13. The method as defined in claim 10, comprising at least partially filling the blast hole with an explosive substance using the second tool.

14. The method as defined in claim 10, comprising rotating the first or second tool using a rotary driver.

* * * * *